United States Patent [19]

Pardo

[11] Patent Number: 4,909,970

[45] Date of Patent: Mar. 20, 1990

[54] BIAXIAL CONCRETE MASONRY CASTING METHOD

[75] Inventor: Jorge Pardo, Reston, Va.

[73] Assignee: National Concrete Masonry Association, Herndon, Va.

[21] Appl. No.: 298,342

[22] Filed: Jan. 17, 1989

Related U.S. Application Data

[63] Continuation of Ser. No. 23,941, Mar. 10, 1987, abandoned, which is a continuation of Ser. No. 698,373, Feb. 4, 1985, abandoned.

[51] Int. Cl.[4] ..... B28B 7/10; B28B 7/20; B28B 13/06

[52] U.S. Cl. ..... 264/40.5; 264/318; 264/333; 264/334

[58] Field of Search ..... 264/333, 334, 336, 318, 264/335, 40.5, DIG. 78, 40.1, 256; 249/62, 64, 145, 151, 176, 185, 66.1, 178, 180, 144, 27, 37, 148, 152, 184; 425/253, 255, 413, 414, 812, 356, 138, 150

[56] References Cited

U.S. PATENT DOCUMENTS

| | | | |
|---|---|---|---|
| 1,202,038 | 10/1916 | Eastman | 249/185 |
| 1,321,938 | 11/1919 | Norton | 249/180 |
| 1,548,485 | 8/1925 | Quimby | 249/145 |
| 1,623,560 | 4/1927 | Sherman | 249/145 |
| 2,567,549 | 9/1951 | Christensen | 425/812 X |
| 3,415,482 | 12/1968 | Schmidgall | 249/145 |
| 3,418,767 | 12/1968 | Seeger | 249/66.1 |
| 3,497,174 | 2/1970 | Nayagam | 249/180 |
| 3,952,991 | 4/1976 | Schneider | 249/66.1 |
| 4,274,824 | 6/1981 | Mullins | 425/413 X |
| 4,614,326 | 9/1986 | Strickland et al. | 249/152 X |

FOREIGN PATENT DOCUMENTS

| | | | |
|---|---|---|---|
| 496182 | 4/1976 | U.S.S.R. | 249/63 |
| 933469 | 6/1982 | U.S.S.R. | 249/145 |

*Primary Examiner*—Jan H. Silbaugh
*Assistant Examiner*—Karen D. Kutach
*Attorney, Agent, or Firm*—Lowe, Price, LeBlanc, Becker & Shur

[57] ABSTRACT

Methods for biaxially (or triaxially) casting concrete masonry ("CM") products like CM blocks which have twin cavities formed by a pair of face shells and three webs interconnecting same with the twin cavities extending in the direction of the axis of casting of the CM block include using in the mold cavity one or more main mold cores which incorporate structure for extending and retracting a plunger or the like to provide one or more temporary mold cores laterally extending into the mold cavity from one or more main mold cores along a second axis which is normal to the axis of casting during certain selected phases of the CM casting process so as to form openings extending through one or more webs in the direction of the second axis.

15 Claims, 9 Drawing Sheets

PRIOR ART Fig.1
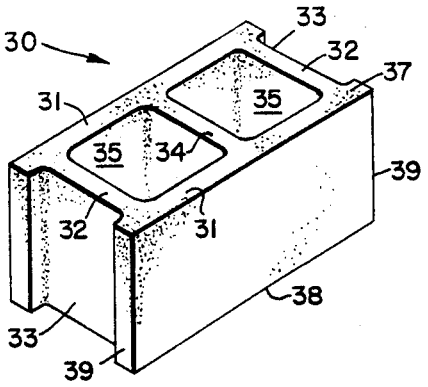
Fig.2
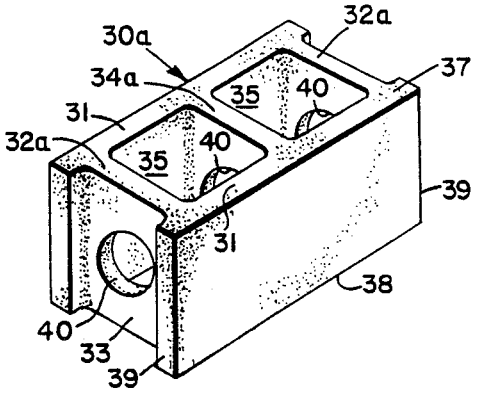
Fig.3
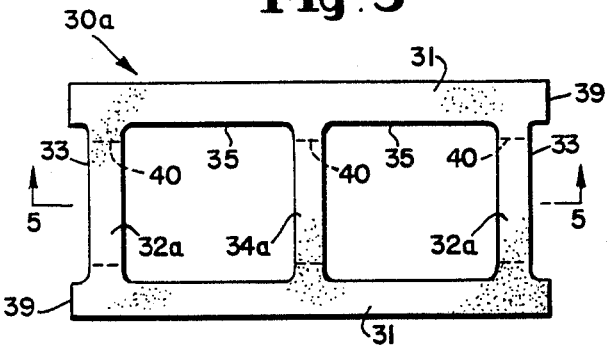
Fig.4
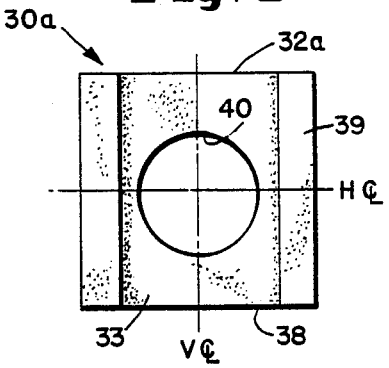
Fig.5
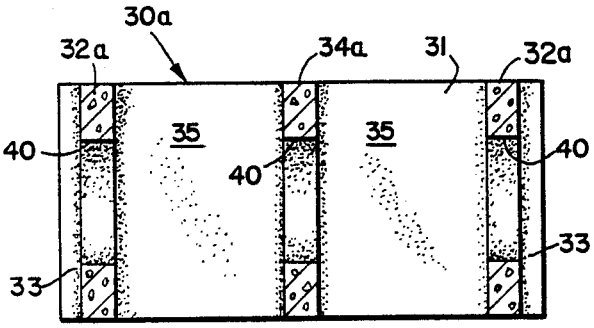
Fig.5A
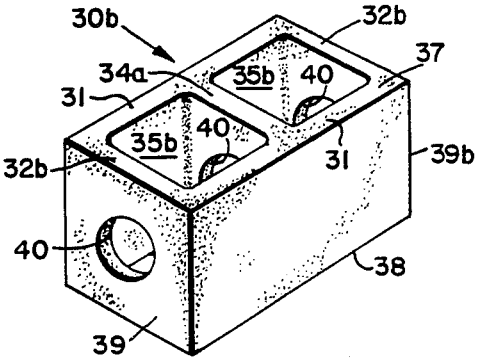

CORE MOLD ASSEMBLY WITH PLUNGERS RETRACTED
CORE MOLD ASSEMBLY WITH PLUNGERS EXTENDED
Low pressure
Pistons retract
Pistons extend

BIAXIAL CONCRETE MASONRY CASTING METHOD

This is a continuation of Ser. No. 023,941, filed 3/10/87, now abandoned, which is a continuation of Ser. No. 698,373, filed 2/4/85, now abandoned.

The present invention relates to novel methods and apparatus for biaxial casting of concrete masonry products such as concrete masonry blocks so as to produce openings and shape indentations along the axis perpendicular to the axis of casting.

The prevailing system for manufacture of concrete masonry blocks and like nits ("CM blocks", "CM units" or "CM products") is characterized by a methodology in which a fluid or semifluid concrete masonry ("CM") composition is compression cast within a mold and the CM product stripped at the opposite end from which it was fed and along the same axis. The process is similar to that of extrusion except that in the concrete masonry industry the CM product is produced in discreet segments or units rather than as a continuous casting such as is used to form products of relatively long length. One of the limiting parameters of such existing CM block manufacturing process is established by the fact that since the accretion of the molding materials occurs lineally along the axis of the mold aperture the resultant CM product shapes which can be made may be varied only as a function of the mold aperture cross section. That is, the shape of the CM blocks or other CM products made with prior existing methods and equipment is basically limited to variation in the same axis as that of the flow of the material in the casting process. This limitation necessitates that CM product shape modification along the axis perpendicular to the flow of the material during casting becomes an expensive secondary manufacturing step which in most cases cannot be economically justified.

There have been some systems developed for making CM products provided with shape indentations along an axis perpendicular to the casting direction axis. One example is a "Horizontal Core Adapter" system made and sold by Besser Company of Alpena, Mich., whereby it is possible to make concrete masonry blocks having top and/or bottom surfaces indented to provide interlocking blocks, reinforcement blocks or decorative blocks. However, such systems have short-comings in that the equipment is relatively expensive, the rate of CM block production is relatively slow, and the molds tend to wear out very quickly because the CM materials are very abrasive. It is noted, however, that such prior systems here mentioned do not involve a biaxial concrete masonry casting method and apparatus such as disclosed herein and claimed as my invention.

The present invention provides a new technological approach including novel method and apparatus for manufacturing CM blocks or other CM products based on variation of the mold aperture during casting timed in such a way that it results in CM product shape variations along an axis normal to the axis of CM material flow. This eliminates the necessity of secondary manufacturing operations to produce such openings or other shape variations along the axis of the CM product perpendicular to the axis of casting.

The biaxial concrete masonry casting method and apparatus of this invention is achieved by a novel relatively inexpensive modification of a conventional CM mold core system to provide a biaxial CM mold core system which may be readily installed or retrofitted in commercially available CM casting machines for making CM blocks and like products. Thus conventional CM casting machines can be converted at low cost for fast and economical biaxial casting of CM blocks and other CM products so as to produce such products having openings and shape indentations along an axis of the product perpendicular to the axis of casting. It is an important feature of the present invention that the novel biaxial CM mold core apparatus for this new system is compact for use in existing molds of commercially available CM casting machines. Specifically, such new apparatus according to the present invention incorporates reciprocal actuating plungers which cause biaxial shape modification of the CM blocks or like CM products during casting but are contained within the confines of mold cores such as normally used for making CM products having conventional cavities extending in the direction of the axis of casting.

It is an object of the present invention to provide CM blocks or like products having cavities extending not only along the axis of casting but also having apertures in one or more of the center and end web portions of the CM blocks and/or in the face shells thereof, such apertures extending along an axis normal to the direction of material flow during casting, with such apertures being made in a single casting operation without any secondary operations.

It is another object of the present invention to provide method and apparatus for making CM blocks wherein the mold aperture may be varied during casting timed in such a way that it will result in apertures in one or more of the center and two end webs of the CM blocks, and in the face shells thereof, such aperture being formed along an axis normal to flow of the CM materials during casting (called the "axis of casting").

It is still another object of the present invention to provide novel method and apparatus which can make such CM blocks having openings in the webs thereof, and in their face shells, along an axis or axes perpendicular to the axis of casting at a fast rate of production comparable and competitive with typical commercial production rates for making conventional CM blocks, for example, a block about every six seconds.

It is another object of this invention to provide a biaxially cast CM "T-block" which has openings in one end web and the center web thereof extending along a second axis perpendicular to a first axis of casting of the CM block plus two substantially aligned openings in opposite face shells of the CM block extending along a third axis perpendicular to the axis of casting and also perpendicular to said second axis of said web openings. It is a related object to provide such a biaxially cast CM T-block whereby plumbing and/or electrical conduits or the like and/or air can pass through all or some of said openings in the T-block. It is another related object to provide such a biaxially cast CM T-block which can be used for interconnecting CM block walls made of biaxially cast CM blocks having openings in each of the three webs of such CM block. It is still another related object of this invention to biaxially cast such a CM "T-block" in which said openings in said webs and face shells are simultaneously made during casting of the CM block without secondary operations (sometimes called "triaxial CM casting", as well as "biaxial CM casting").

It is a further object of the present invention to provide a biaxially cast CM "L-block" which has openings in one end web and the center web thereof extending along a second axis perpendicular to a first axis of casting, plus one opening in one of the face shells of the L-block adjacent another end web of said block (which does not have an opening therein) said opening in said face shell extending along a third axis perpendicular to the axis of casting and also perpendicular to said second axis. It is a related object to provide such a biaxially cast CM L-block whereby plumbing and/or electrical conduits or the like and/or air can pass through said openings in the L-block. It is another related object of the present invention to provide such biaxially cast CM L-blocks for making the corners between two walls made up of biaxially cast CM blocks which have openings in each of the webs thereof extending in a direction along said second axis perpendicular to the axis of casting. It is another related object of this invention to cast such a CM "L-block" in which said openings in said webs and said face shells are simultaneously made during casting of the CM block without secondary operations (sometimes called "triaxial CM casting", as well as "biaxial CM casting").

It is another object of the present invention to provide biaxially cast CM blocks having openings in the center and two end webs thereof, and in the face shells thereof, which are producible with commercially available fast-rate CM casting machines so that such biaxially cast CM blocks may be used to make concrete masonry block walls and like structures with the openings in the CM block webs providing horizontally extending conduits within such CM block walls. Such horizontally extending conduits in the CM blocks may be used for accomodating wiring or plumbing pipe or the like extending horizontally with CM block walls made with biaxially cast CM blocks. Such horizontally extending openings and conduits also enable distribution of air through such CM block walls.

It is a related object of the invention to provide such biaxially cast CM blocks with openings in the center and side webs, and sometimes also in the face shells, which use less concrete masonry material, yet maintain adequate strength in the field. It is another related object to provide such biaxially cast CM blocks and like products which are lighter and better for shipment and assembly; and which can be more easily hand-held and manipulated by workmen when constructing walls or the like in the field; and which have a number of other advantages now made realizable by use of the novel methods and apparatus for biaxial casting of such CM blocks at a fast rate with existing commercially available CM block casting machinery.

It is a further objective of the present invention to provide novel method and apparatus for biaxial casting of CM blocks and other CM products so as to provide openings and shape indentations along an axis perpendicular to the axis of casting and achieve various other objects and advantages which are stated below in the description of the present inventions.

The above discussed and other objects and advantages of the present inventions will become apparent from the following specification, appended claims and the accompanying drawings in which:

FIG. 1 is a perspective view of a conventional twin-cavity CM block such as made with commercially available CM block casting machines in which a semi-fluid concrete masonry mix is compression cast within a mold and stripped at the opposite end from which it was fed along the axis of casting.

FIG. 2 is an isometric view of a biaxially cast CM block which is generally similar to the conventional CM block shown in FIG. 1 but has apertures in the center and two end webs of the block made during casting of the block using my novel method and apparatus for biaxial casting according to the present invention.

FIG. 3 is a top plan view of the biaxially cast CM block shown in FIG. 2.

FIG. 4 is an end elevation view of the biaxially cast CM block shown in FIGS. 2 and 3.

FIG. 5 is a longitudinal cross-sectional view of the biaxially cast CM block taken along line 5—5 in FIG. 3.

FIG. 5A is an isometric view of a modified biaxially cast CM block which is like the biaxially cast CM block of FIGS. 2–5, but is modified so that its end webs are in alignment with the ends of its face shells rather than being spaced therefrom as in the block of FIGS. 2–5.

Figure 6:
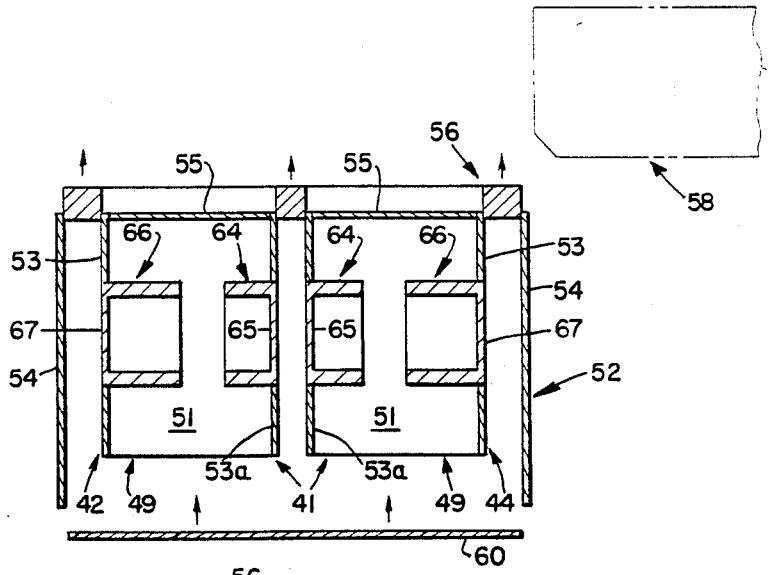

FIG. 6 is a schematic or diagrammatic illustration of components of a biaxial CM casting apparatus in one phase of a biaxial CM casting process for making biaxial CM blocks according to the present invention. FIG. 6 shows a biaxial CM mold core system according to the present invention installed in the mold box of a conventional CM casting machine; and this figure shows the mold being fed a conventional bottom pallet, with the compression/stripper shoe on its way up to provide access for the feed tray to the mold.

Figure 7:
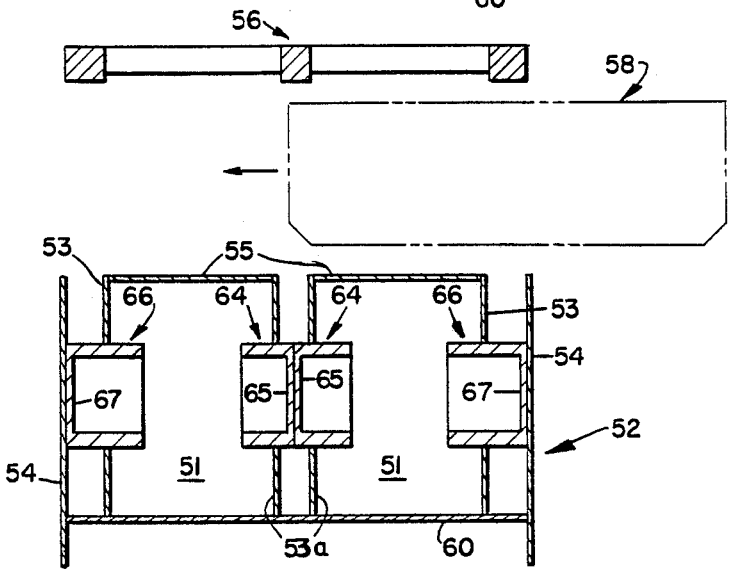

FIG. 7 is a schematic of the biaxial CM casting apparatus components shown in FIG. 6 but in another phase of the biaxial CM casting process wherein the bottom pallet is in place and the axial plungers are extended from the biaxial CM mold cores (whereas in FIG. 6 such axial plungers are retracted within such cores).

Figure 8:
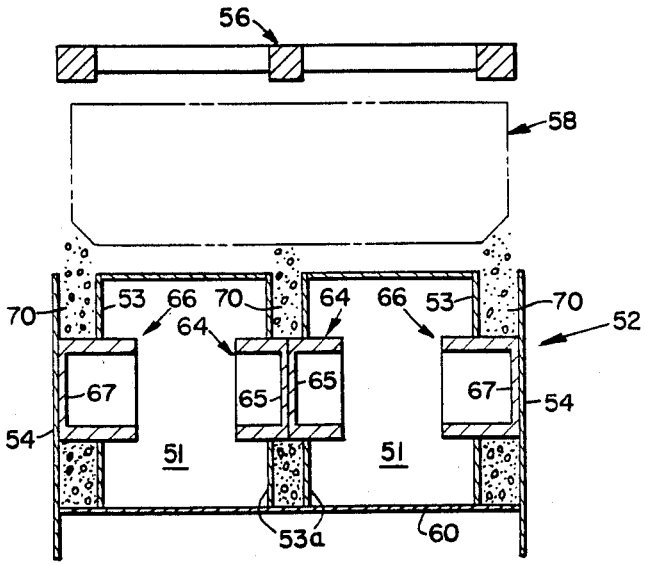

FIG. 8 is a schematic of the biaxial CM casting apparatus components shown in FIG. 7 but in another phase of the process wherein semifluid concrete masonry mix is being fed into the mold cavity while said axial plungers are extended from the biaxial CM mold cores.

Figure 9:
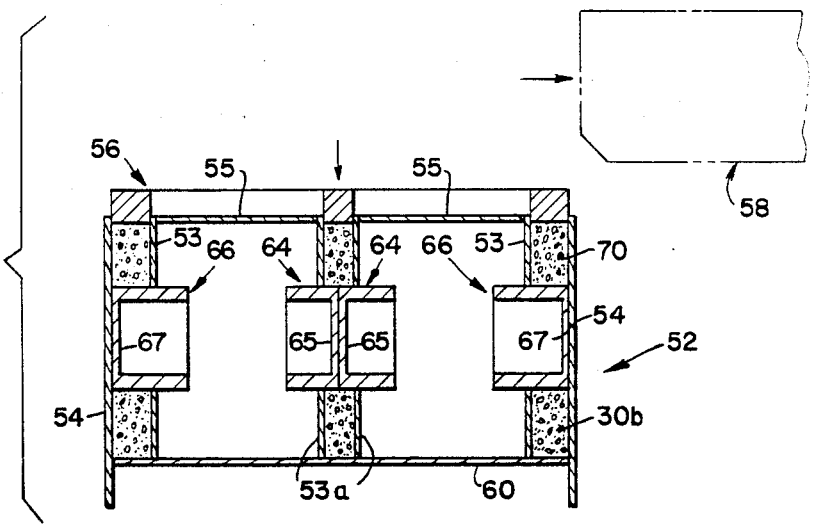

FIG. 9 is a schematic of the apparatus of FIG. 8, but shows another phase of the process wherein the feed tray has withdrawn and the stripper shoe has come down to compress the CM mix in the mold as vibration proceeds while said axial plungers are extended from the biaxial CM mold cores.

Figure 10:
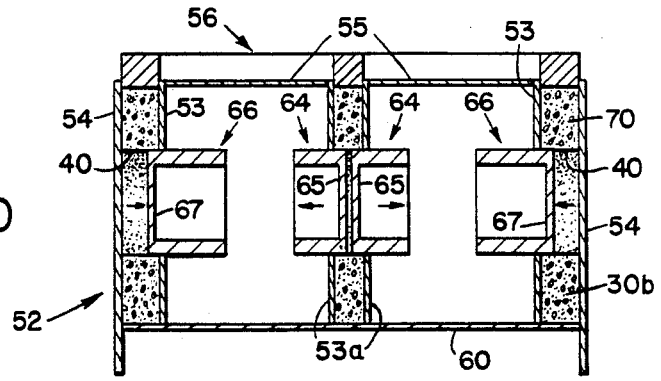

FIG. 10 is similar to that of FIG. 9 but shows another phase wherein the axial plungers are being retracted to inside the biaxial mold cores after completion of the CM block compression cycle.

Figure 11:
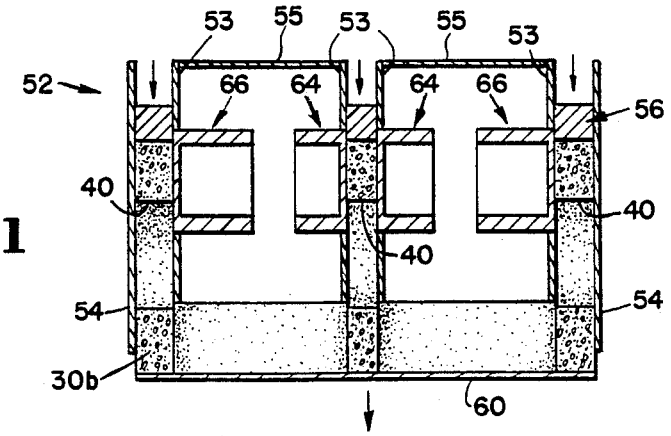

FIG. 11 is similar to FIG. 10 but shows another phase wherein the axial plungers are fully retracted within the hollow mold cores and the compressed CM material formed into a CM block is being stripped from the mold cavity through simultaneously downward motion of the compression/stripper shoe and the bottom pallet.

Figure 12:
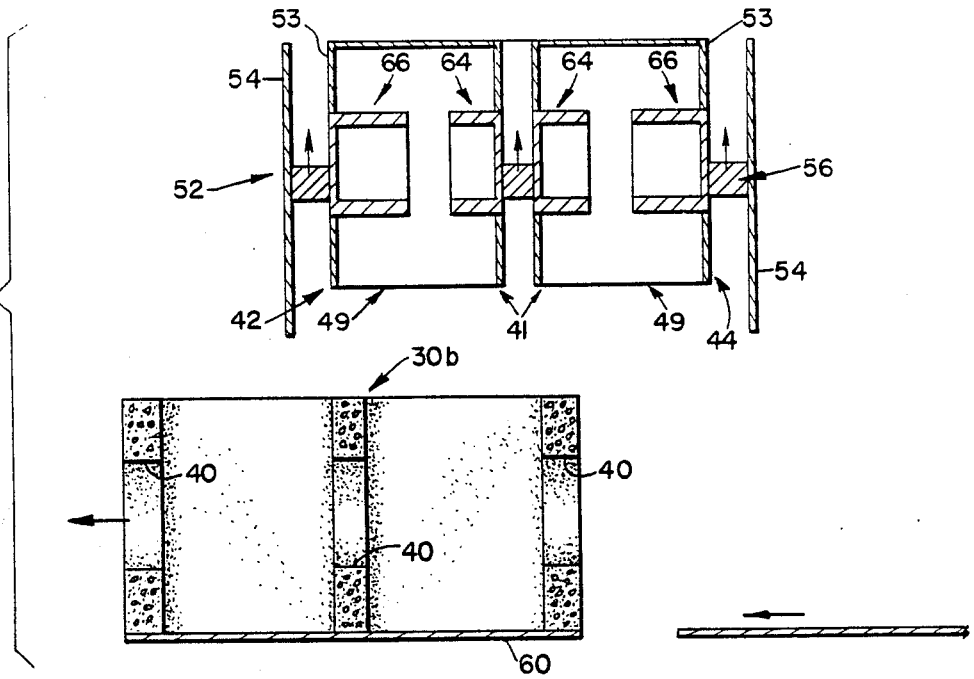

FIG. 12 is a schematic drawing showing various components of the biaxial CM casting apparatus shown in FIGS. 6 through 11, but FIG. 12 illustrates another phase of the process wherein the compression/stripper shoe returns upward past the axial plungers which are retracted within the biaxial CM mold cores, while the newly cast CM block is being ejected on its individual pallet onto a conveyor—whereby the steps of FIGS. 6 through 11 can be repeated when the compression/-stripper shoe moves upwardly out of and above the mold box.

Figure 13:
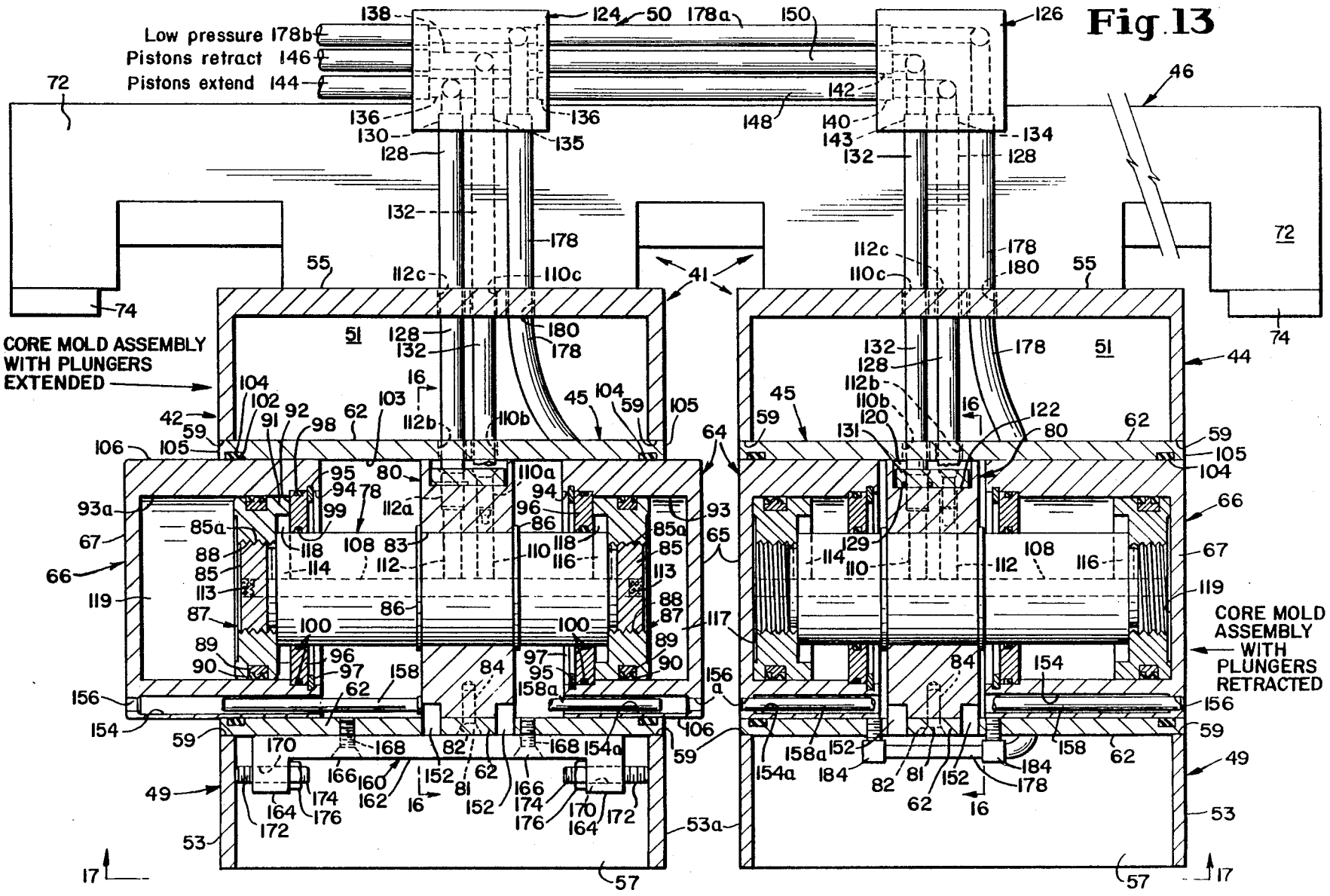

FIG. 13 is a partly cross-sectional view and partly side-elevational view of a biaxial CM mold core system plus mounting means and air conduit means for installing and operating the biaxial CM mold core system in a commercially available CM block casting machine. In the mold core on the right side of FIG. 13, the axial plungers are shown fully retracted within the mold core as they would be in phases of operation illustrated in FIGS. 6, 11 and 12 hereof. In contrast, for convenient disclosure, the mold core on the left side of FIG. 13 shows the axial plungers fully extended from the mold core as they would be in phases of operation shown in FIGS. 7, 8 and 9 hereof.

Figure 14:
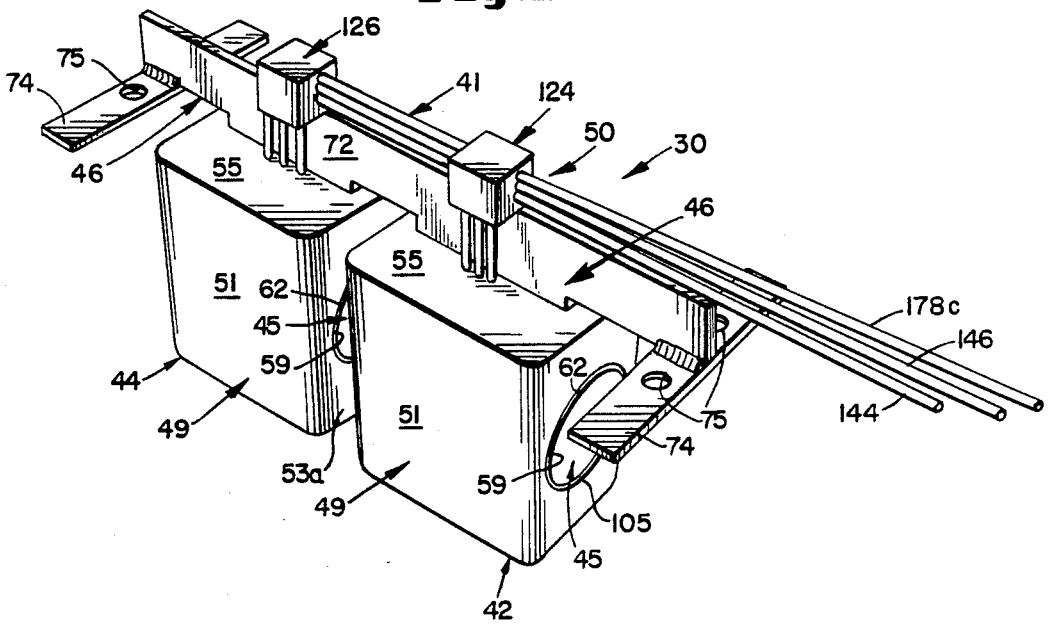

FIG. 14 is a perspective view (looking from the top) of the biaxial CM mold core system plus related mounting means and air conduit means shown in FIG. 13.

Figure 15:
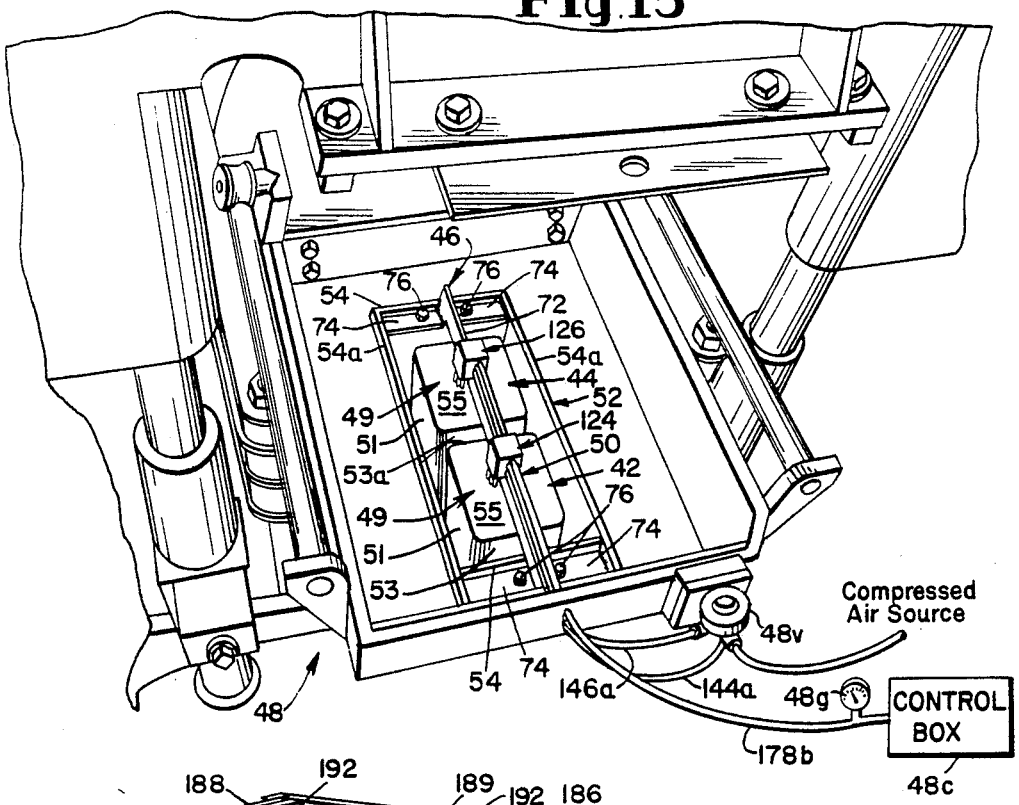

FIG. 15 is a perspective view showing part of a conventional CM block casting machine and the biaxial CM mold core system and related components shown in FIGS. 13 and 14 installed in the CM block casting machine with the two mold cores of said system disposed in the mold box of the casting machine.

Figure 16:
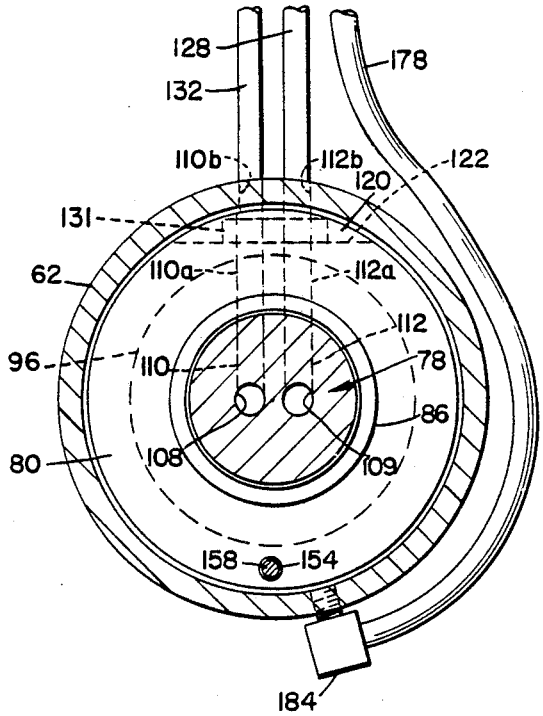

FIG. 16 is a cross-sectional view of the biaxial plungers sub-assembly shown in FIG. 13, taken along line 16—16 of the mold core shown at the right side of FIG. 13.

Figure 17:
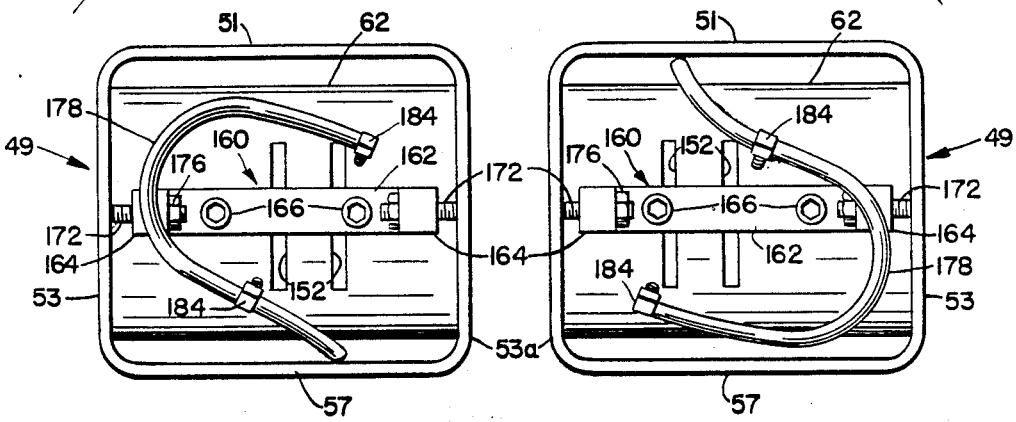

FIG. 17 is a bottom plan view of the mold core assemblies shown in FIGS. 13 and 14, looking upwardly along line 17—17 in FIG. 13.

Figure 18:
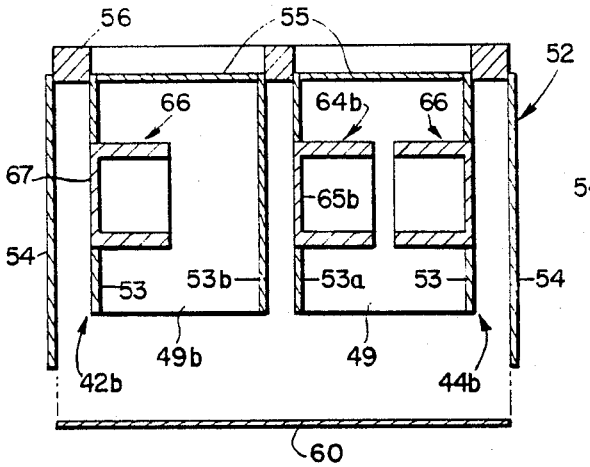

FIG. 18 is a schematic or diagrammatic illustration of a modified biaxial CM casting apparatus for use in a CM manufacturing process for making biaxial CM blocks according to the present invention. The modified apparatus of FIG. 18 corresponds to part of the embodiment shown in FIGS. 6–12 but shows a biaxial CM mold core system including only three axial plungers, one in the mold core at the left of FIG. 18 and two in the mold core at the right of FIG. 18 (said axial plungers being shown in fully retracted position in this figure).

Figure 19:
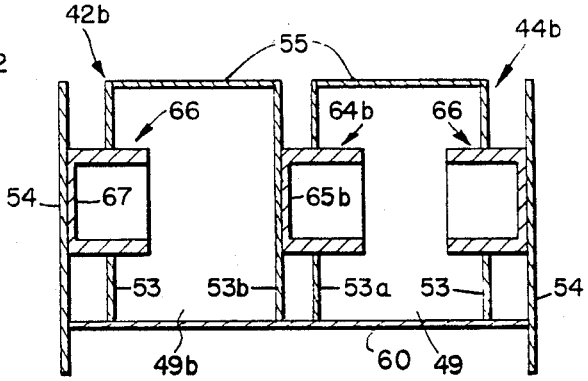

FIG. 19 is a schematic illustration of the modified biaxial CM apparatus shown in FIG. 18, but with all three axial plungers shown in extended position during part of the biaxial CM casting process (similar to the corresponding parts of the apparatus shown in FIGS. 7, 8 and 9).

Figure 20:
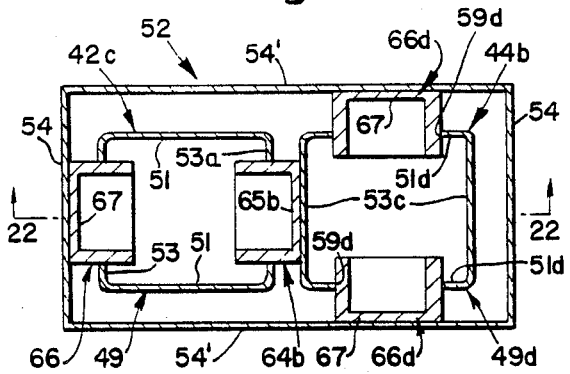
Figure 24:
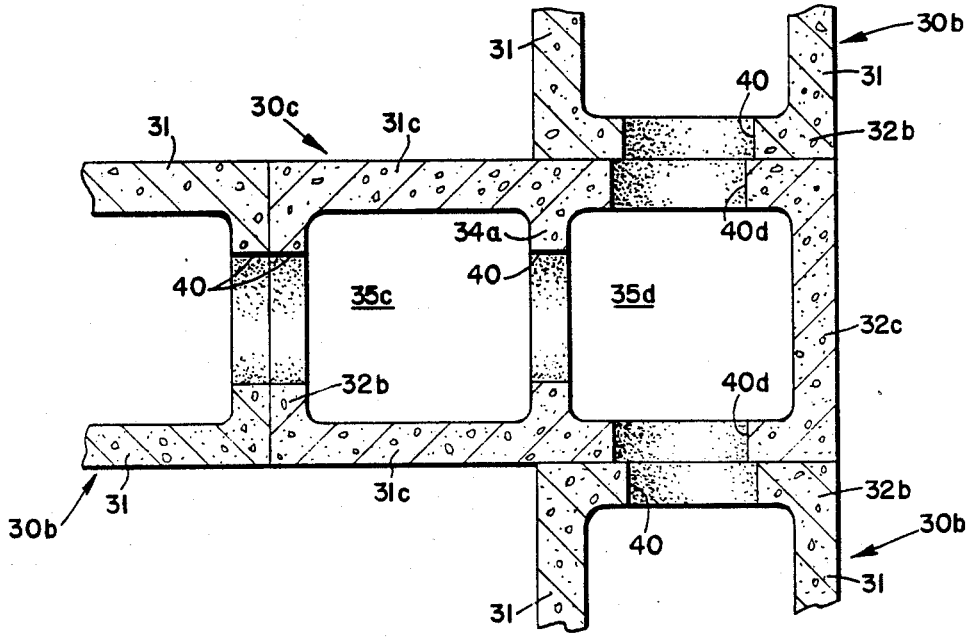

FIG. 20 is a schematic illustration of another modified biaxial CM casting apparatus for use in a biaxial CM casting process to make biaxial CM "T-blocks" shown in FIG. 24 according to the present inventions. FIG. 20 shows a top view of the mold box and mold sides and a cross-section of the mold core assemblies taken at the level of the central axes of the axial plungers of said mold core assemblies in FIG. 20.

Figure 21:
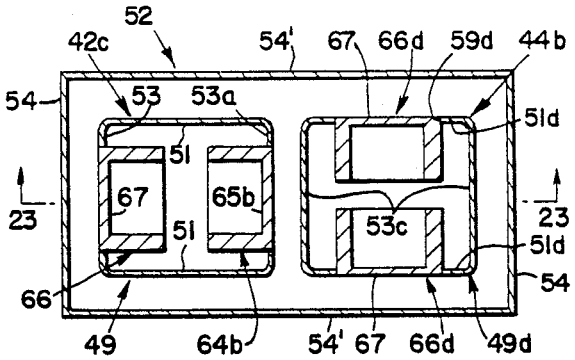

FIG. 21 is a top plan and cross-sectional view of the mold box and mold core assemblies similar to FIG. 20 but showing all of axial plungers of the mold core assemblies in retracted position (instead of their being in extended position as shown in FIG. 20).

Figure 22:
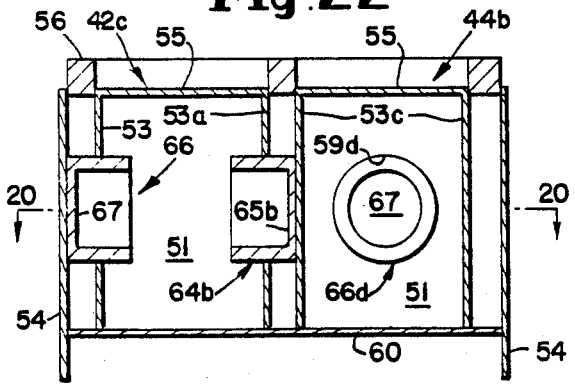

FIG. 22 is a vertical section of the modified embodiment for making biaxial CM T-blocks shown in FIGS. 20 and 21, taken along line 22—22 in FIG. 20. FIG. 22 shows the embodiment of FIGS. 20–23 with the axial plungers in extended position in a phase of operation for the embodiment of FIGS. 20–23 analogous to the phase of operation shown in FIG. 19 for the embodiment of FIGS. 18–19 described below.

Figure 23:
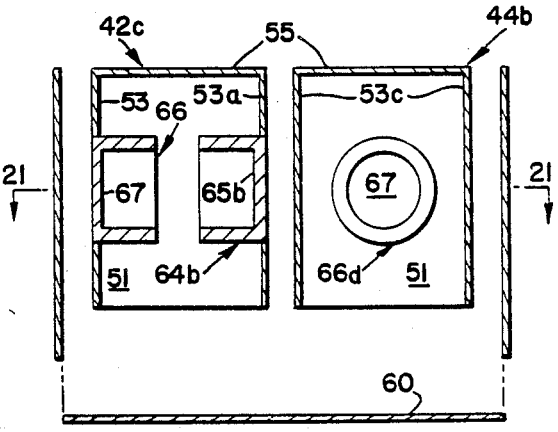

FIG. 23 is a vertical section of the modified embodiment shown in FIGS. 20–22 taken along line 23—23 in FIG. 21. FIG. 23 shows the embodiment of FIGS. 20–23 in a phase of operation for said embodiment similar to the phase of operation shown in FIG. 18 for the embodiment of FIGS. 18–19.

FIG. 24 shows a modified biaxially cast CM "T-block" which is generally like the above-described biaxially cast CM block of FIG. 5A but which has openings in one end web and the central web extending normal to the axis of casting, and which also has two aligned openings in the block face shells communicating with one of the twin cavities of the CM block and thus with said openings in said webs and with the other twin cavity of the T-block. Also, the T-block shown in FIG. 24 can be used to provide a "T-wall-connection" as illustrated in FIG. 24 when such T-block is used with two adjoining CM blocks **30*b* of the kind shown in FIG. 5A at the ends of two intersecting walls made with such CM blocks 30*b***.

Figure 25:
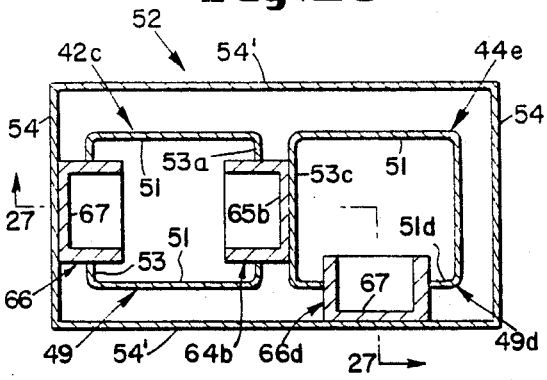
Figure 29:
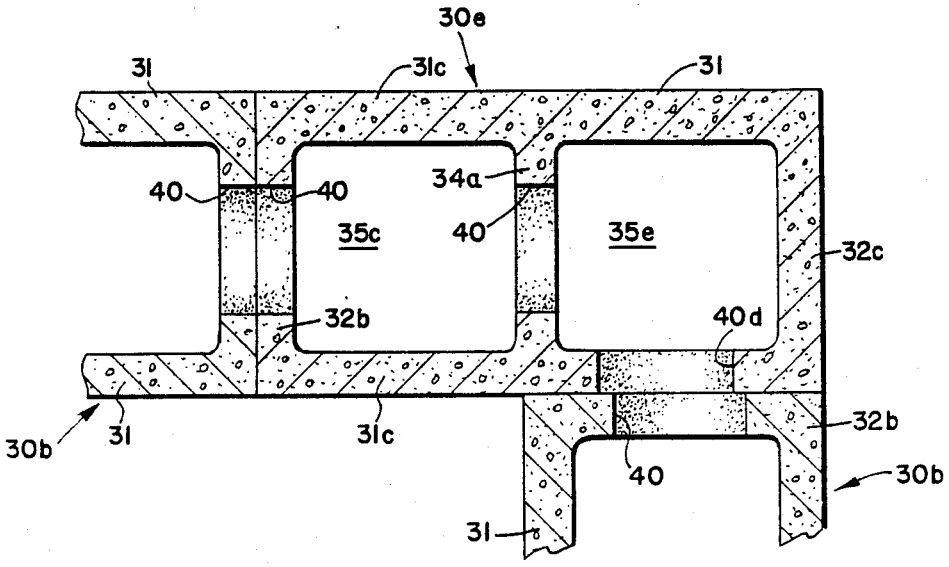

FIG. 25 is a schematic illustration of another modified biaxial CM casting apparatus for use in a biaxial CM casting process to make biaxial CM "L-blocks" shown in FIG. 29 according to the present inventions. FIG. 25 shows a top view of the mold box and mold sides and a cross-section of the mold core assemblies taken at the level of the central axes of the axial plungers of said mold core assemblies in FIG. 25.

Figure 26:
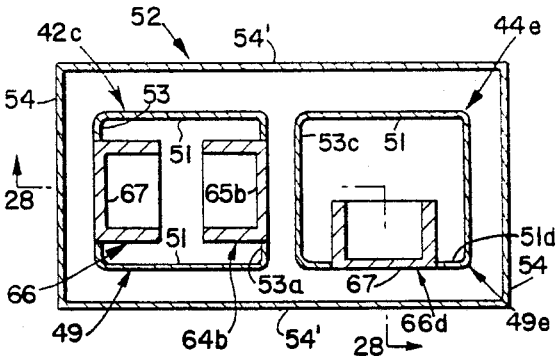

FIG. 26 is a top plan and cross-sectional view of the mold box and mold core assemblies similar to FIG. 25 but showing all of axial plungers of the mold core assemblies in retracted position (instead of their being in extended position as shown in FIG. 25).

Figure 27:
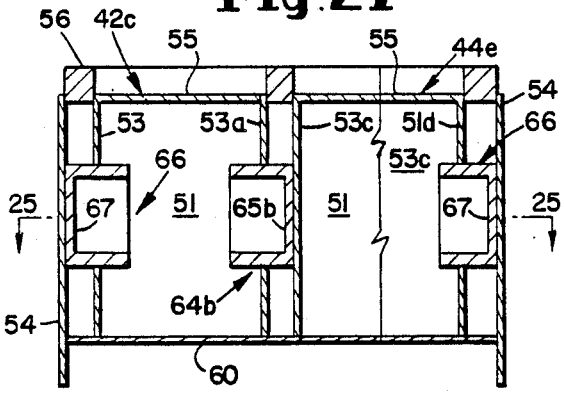

FIG. 27 is a vertical section of the modified embodiment for making biaxial CM L-blocks which is shown in FIGS. 25 and 26, taken along line 27—27 in FIG. 25. FIG. 27 shows the embodiment of FIGS. 25–28 with the axial plungers in extended position in a phase of operation for the embodiment of FIGS. 25–28 analogous to the phase of operation shown in FIG. 19 for the embodiment of FIGS. 18–19 described below.

Figure 28:
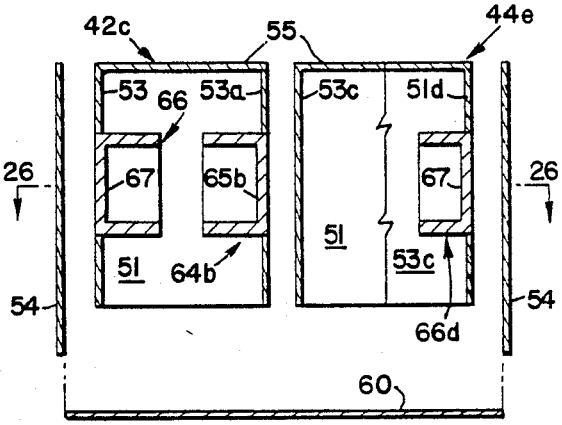

FIG. 28 is a vertical section of the modified embodiment shown in FIGS. 25–27 taken along line 28—28 in FIG. 26. FIG. 28 shows the embodiment of FIGS. 25–28 in a phase of operation for said embodiment similar to the phase of operation shown in FIG. 18 for the embodiment of FIGS. 18–19.

FIG. 29 shows a modified biaxially cast CM "L-block" which is generally like the above-described biaxially cast CM block of FIG. 5A but which has openings in one end web and the central web extending normal to the axis of casting, and which also has one opening in one of the block face shells communicating with one of the twin cavities of the CM block and thus with said openings in said webs and with the other twin cavity of the L-block. Also, the L-block shown in FIG. 29 can be used to provide a "corner connection" as illustrated in FIG. 29 when such L-block is used with one adjoining CM block **30*b* of the kind shown in FIG. 5A at the end of a row of such CM blocks 30*b***.

Figure 30:
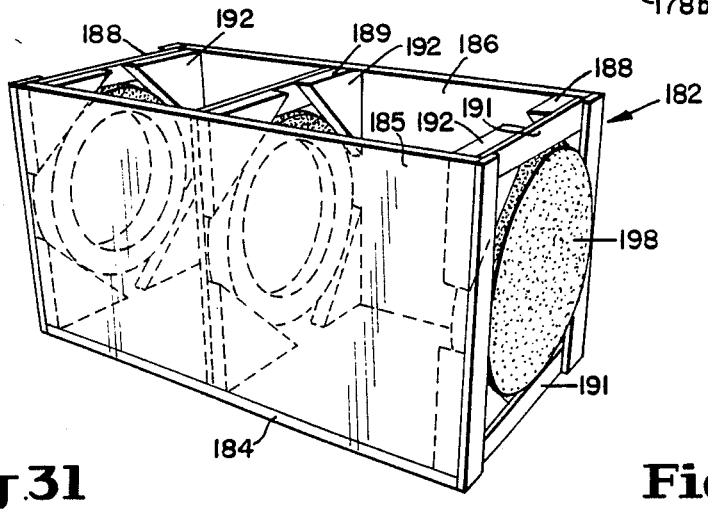

FIG. 30 is a perspective view of a "biaxial maintenance module" used for cleaning the axial plungers of the biaxial CM mold core system shown in FIGS. 13 and 14 at the end of a particular run or working day or the like.

Figure 31:
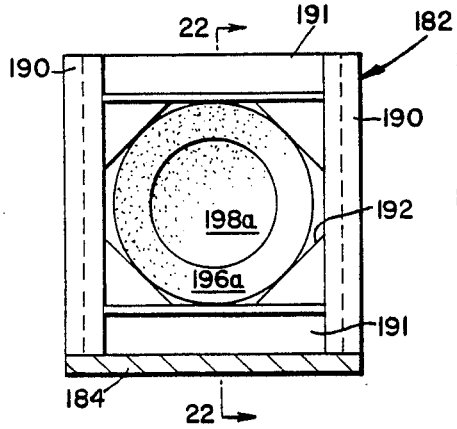

FIG. 31 is an end elevation view of the biaxial maintenance module shown in FIG. 30.

Figure 32:
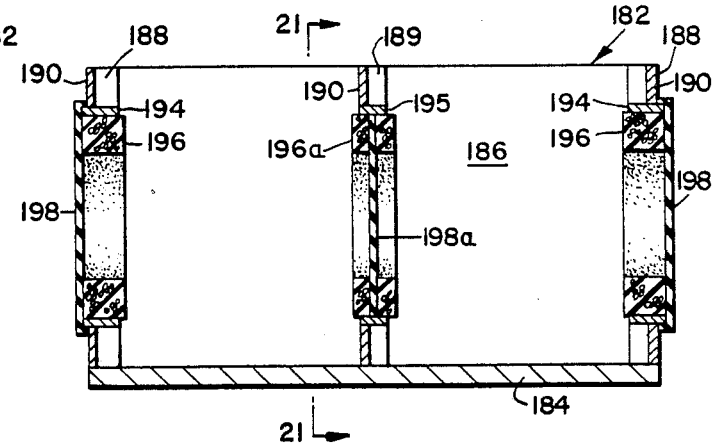

FIG. 32 is a longitudinal sectional view of the biaxial maintenance module shown in FIGS. 30 and 31, taken along line 32—32 in FIG. 31.

In the accompanying drawings, like parts are identified with like numerals. Modified components or parts are sometimes identified by like numerals plus subscripts as below set forth to conveniently indicate similarities and differences between various embodiments.

Reference is now made particularly to FIG. 1 which shows a conventional twin-cavity CM block generally indicated at 30. CM block 30 comprises two relatively elongated substantially parallel face shells 31 which are interconnected by two laterally extending end webs 32 and a center web 34. The two face shells 31 and the three webs 32,34 form two cavities 35 which extend through the CM block 30 from the top 37 to the bottom 38 thereof in the direction of the axis of casting of conventional CM block 30 in a conventional commercially available CM block casting machine. Each of block cavities 35 has a substantially rectangular cross-section, and both cavities 35 have substantially the same dimensions. Each of face shells 31 are of like thickness, and each of the three webs 32,34 are of like thickness. (Representative dimensions of the conventional twin-cavity CM block 30 and its components are the same or substantially the same as dimensions of corresponding components of the below-described novel biaxially cast CM block generally indicated at 30*a* in FIGS. 2–5.)

Reference is now made particularly to FIGS. 2–5 which show a novel biaxially cast twin-cavity CM block generally indicated at 30*a*. Biaxially cast CM block 30*a* comprises longitudinally extending substantially parallel face shells 31 which are interconnected by two laterally extending end webs 32*a* and a center web 34*a*. The face shells 3 and the three webs 32*a*,34*a* form two cavities 35 which extend through the block 30*a* from the top 37 to the bottom 38 thereof in the direction of the flow of CM material during casting of biaxially cast CM block 30*a*. For a suitable and typical biaxially cast twin-cavity CM block made according to the present invention, the various nominal dimensions of components of CM block 30*a* would be substantially as follows: overall length of face shells 31 in direction perpendicular to the axis of casting is 15.625 inches; thickness of face shells 31 is 1.25 inches; overall block width measured between the two outer surfaces of face shells 31 is 7.625 inches; transverse distance between the inside surfaces of face shells 31, and thus the transverse dimension of each cavity 35, is 5.125 inches; each of end webs 32*a* is inset from ends 39 of the block 0.75 inches; the thickness of each of webs 32*a* and 34*a* is 1 inch; and the distance between each end web 32*a* and center web 34*a*, and thus the longitudinal dimension of each cavity 35, is 5.56 inches; the height of the block 30*a* between top 37 and bottom 38 is 7.625 inches.

The biaxially cast CM block 30*a* of FIGS. 2–5 differs from the conventional CM block 30 of FIG. 1 in that there are openings or apertures 40 extending through each of the end webs 32*a* and the center web 34*a* with the axis of each opening 40 being substantially normal to the direction of material flow during casting (i.e., the "axis of casting"). The openings 40 in the webs 32*a* and 34*a* are made by varying the mold aperture during casting and timing such variation of mold aperture in such a way as to result in variation of the shape of the CM block 30*a* by providing openings 40 which are formed normal to the axis of casting without a secondary manufacturing operation, as further below explained. The openings 40 in webs 32*a* and 34*a* of biaxially cast CM block 30*a* having typical dimensions above-described may have a diameter of about 3 to 4 inches. The center of openings 40 is located on, or substantially on, the block's vertical centerline VCL which is midway between the outer surfaces of block face shells 31; and the center of openings 40 is also located at or slightly below the block's horizontal centerline HCL which is at the vertical midpoint of the block between top 37 and bottom 38. The configuration, size and location of biaxially cast openings 40 must be such as to avoid problems of inducing cracking in the manufacture of biaxially cast CM blocks 30*a*. The openings 40 of CM block 30*a* are likely to be circular as shown in FIGS. 2–5, and located and sized as hereinabove set forth. The configuration, size and location of biaxially cast openings such as 40 are a function of the dimensions of the biaxially cast CM block and its components and of the size, shape and location of such openings. It is possible to use different non-circular configurations for opening 40, and different sizes and locations for such openings in relation to block centerlines HCL and VCL, as will be apparent to those skilled in the art in light of the disclosure herein.

Reference is now made to FIG. 5A described above showing a biaxially cast CM block 30*b* which is a modification of biaxially cast CM block 30*a* shown in FIGS. 2–5 and described above with reference thereto. The biaxially cast CM block 30*a* of FIGS. 2–5 is an "open end block" having a pair of inset recesses 33 at opposite ends of block 30*b* made by inserting end cores in the mold box (such as shown at 54 in below-described FIG. 15); this is done in like manner as providing-like inset recesses 33 at opposite ends of a conventional open end block such as shown at 30 in FIG. 1. However, by not using such end cores in the mold box, the biaxially cast CM block 30*b* will have a modified configuration as shown in FIG. 5A differing from above-described CM block 30*a* shown in FIGS. 2–5. The difference between biaxially cast CM block 30b of FIG. 5A as compared to biaxially cast CM block 30*a* is that the end webs 32*b* have their outer surfaces aligned with block ends 39, and the longitudinally extending dimension of cavities 35*b* is correspondingly longer than that of cavity 35 in CM block 30*a* shown in FIGS. 2–5 and above described. Otherwise, components of CM block 30*b* shown in FIG. 5A identified by like numerals in FIG. 5A as in FIGS. 2–5 are of like configuration and size as corresponding like identified components in FIGS. 2–5 excepting that the longitudinal dimension of each cavity 35*b* is 6.31 inches in block 30*b* of FIGS. 2–5 (instead of 5.56 inches as in block 30*a* of FIGS. 2–5).

Reference is now made to FIGS. 6–12 and 13–15. The biaxial CM mold core system generally indicated by numeral 41 includes a pair of mold core assemblies generally indicated at 42 and 44 respectively, plus core bar assembly and mounting means generally indicated at 46 for installing the system 41 in a commercially available CM block casting machine generally indicated at 48, plus air supply means generally indicated at 50 for pneumatically operating the mold core assemblies 42 and 44 of biaxial CM mold core system 41.

The CM casting machine 48 includes a four-sided mold box generally indicated at 52 which has four vertically extending sides 54 disposed substantially at right angles to each other. The CM casting machine 48 also includes a compression and stripper shoe ("compression/stripper shoe") generally indicated at 56, a materials feed tray generally indicated at 58, and means for raising a pallet 60 to form the bottom of the mold for casting a CM block as generally known in the art and as hereinafter discussed. (It is noted that numeral 52 is sometimes used to refer to such mold as well as to the mold box itself.)

Referring especially to FIGS. 13–15 and 17, each of mold core assemblies 42 and 44 includes a generally rectangular-shaped mold core 49 having a pair of opposite vertically disposed like planar side walls 51, plus a pair of opposite vertically disposed like planar end walls 53 and 53*a*, plus a horizontally disposed planar top end wall 55, and an open bottom 57. The mold cores 49 are similar to conventional mold cores used to make conventional twin-cavity CM blocks such as above-described CM block 30 shown in FIG. 1; but each of mold cores 49 is modified by cutting axially aligned circular apertures 59 in opposite sides 53 and 53*a* thereof. A cylindrical assembly sleeve 62 is disposed within each mold core 49 and has its opposite ends mounted in apertures 59 in opposed mold core side walls 53 and 53*a*, as further explained below. An "inner" axially reciprocating plunger indicated at 64 is mounted in one end of cylinder 62 in each mold core assembly 42 and 44 in such manner so that (i) each plunger 64 can be retracted inside of adjacent walls 53*a* of its mold core 49 as shown at the right of FIG. 13 and diagrammatically illustrated in FIGS. 6, 9, 11 and 12; and so that (ii) such plungers 64 can project outside of said mold core walls 53*a* as shown at the left in FIG. 13 and diagrammatically illustrated in FIGS. 6–12. Another somewhat longer "outer" axially reciprocating plunger indicated at 66 is mounted in the other end of cylinder 62 of each mold core assembly 42 and 44 so that (i) each plunger 66 can be retracted inside of adjacent wall 53 of its mold core 49 as shown at the right of FIG. 13 and diagrammatically illustrated in FIGS. 6, 9, 11 and 12; and so that (ii) plungers 66 can project outside of said walls 53 as shown at the left in FIG. 13 and diagrammatically illustrated in FIGS. 6–12. It is noted that the construction and mode of operation of the axial plungers 64 and 66 are the same in each of mold core assemblies 42 and 44. However, for convenience of description of the invention herein, the mold core assembly 42 is shown at the left of FIG. 13 with both of its axial plungers 64 and 66 in extended position projecting outside of walls 53,53*a* of the mold core 49 in position for certain phases of the biaxial CM casting process; whereas the mold core assembly 44 is shown in the right of FIG. 13 with its axial plungers 64 and 66 in retracted position with both said plungers being disposed inside the walls 53,53*a* of the mold core 49 for other phases of the biaxial CM casting cycle.

In the preferred embodiment, the axial plungers 64 and 66 are energized to extend them as shown in the mold core assembly 42 in FIG. 13 (and in FIGS. 7, 8 and 9) and to retract them as shown in the mold core assembly 44 of FIG. 13 (and in FIGS. 6 and 11) by compressed air means as explained in detail below. However, it is noted that axial plungers like 64 and 66 of equivalent mold core assemblies like 42 and 44 could be analogously energized to extend and retract such plungers in similar manner by equivalent mechanical means, electromechanical means, hydraulic means, or a combination of the foregoing, any one or more of which may also be combined with compressed air means, as will be apparent to one skilled in the art in light of the disclosure herein.

Further details of construction and mode of operation of the biaxial CM mold core system 41, mold core assemblies 42 and 44 and their compressed air operated axial plungers 64 and 66, plus related components are set forth below.

Reference is now made particularly to the schematic or diagrammatic drawings of FIGS. 6–12 which show components of a biaxial CM casting apparatus in various phases of a biaxial CM casting process for making biaxial CM blocks like 30*b* (or 30*a*, using end cores) by utilizing the present inventions disclosed and claimed herein.

Referring to FIG. 6, this is a schematic or diagrammatic illustration showing a biaxial CM mold core system 41 installed in the mold box 52 of the CM casting machine. The sides 53 of mold core assemblies 42 and 44 are disposed adjacent to, but suitably spaced from the two shorter sides 54 of mold box 52; and the sides 51 of mold core assemblies 42 and 44 are disposed adjacent to, but suitably spaced from the two longer sides 54*a* of the mold box 52. (See also FIG. 15.) The other sides 53*a* of each mold core 49 of mold core assemblies 42 and 44 are inwardly disposed adjacent to but spaced from each other a suitable distance. As shown in FIG. 6, each of the shorter and longer axial plungers 64 and 66 of mold assemblies 42 and 44 is wholly retracted within the side walls 53 and 53*a* of its mold core 49. FIG. 6 shows a phase of operation of the biaxial CM casting apparatus and a step in the biaxial CM casting method according to this invention wherein the feed tray 58 containing the semifluid CM mix is off to the side of the mold 52, the compression/stripper shoe 56 is being moved on its way up to provide access for the feed tray 58 to the mold 52 and a conventional bottom pallet 60 is being moved upward to form the bottom of the mold 52.

Referring now particularly to FIG. 7, this is a schematic or diagrammatic illustration of the biaxial CM casting apparatus components shown in FIG. 6, but showing such components in a subsequent phase of operation to carry out the biaxial CM casting process according to this invention. In this phase, the bottom pallet 60 is in place to form the bottom of the mold 52, and the compression/stripper shoe 56 is above the level of the feed tray 58 which is moving into position over the mold box 52 for purposes of feeding the semifluid CM mix into mold 52. In this phase, all axial plungers 64 and 66 are caused by compressed air to project in extended position from the mold cores 49 so that the ends 67 of the longer axial plungers 66 abut against adjacent side walls 54 of the mold box 52 and the ends 65 of the shorter axial plunger 64 abut against each other as shown in FIG. 7.

Reference is now made particularly to FIG. 8 which is a similar schematic illustration of the apparatus components shown in FIGS. 6 and 7, but showing such components in another subsequent phase of operation to carry out the biaxial CM casting process according to this invention. In this phase, semifluid CM mix shown at 70 is fed into the cavity of mold 52 while said axial plungers 64 and 66 are still extended from the mold core assemblies 42 and 44 as shown in FIG. 7 and explained above with reference to FIG. 7.

Reference is now made particularly to FIG. 9 which is a similar schematic illustration of apparatus components shown in FIG. 8 but showing still another subsequent phase of the biaxial CM casting process of this invention. In this phase, the feed tray 58 has been laterally withdrawn from its position over the mold 52 permitting the compression/stripper shoe 56 to come down and compress the CM mix 70 in the mold 52 as vibration of the mold proceeds by conventional means incorporated in CM casting machine 48. During this phase of operation said axial plungers 64 and 66 remain extended from the mold cores 42 and 44 as shown in FIGS. 9, and shown and described above with reference to FIGS. 7 and 8. Hence, in the phases of operation shown in FIGS. 9 an 8 the extended axial plungers 66 have their ends 67 abutting adjacent mold box side walls 54 and axially extending plungers 64 have their ends 65 abutting each other so as to prevent CM mix 70 from filling in the spaces in mold 52 thus occupied by the portions of said extended plungers 64 and 66 projecting from both mold cores 49, as will be apparent from FIGS. 9 and 8 and the foregoing description thereof. This causes the formation of openings 40 in end webs **32*b* and in center web 34*a* of the biaxially cast CM block 32*b* shown in FIG. 5A and described above with reference to that figure plus FIGS. 2–5. (This is in contrast to conventionally cast twin-cavity CM blocks 30 such as shown in FIG. 1, which have solid end and center webs due to use of conventional mold cores that do not incorporate axial plungers 64 and 66**, or other equivalent means.)

Reference is now made particularly to FIG. 10 which is a schematic illustration of apparatus components similar to that of FIG. 9, but shows a next phase of apparatus operation for carrying out the biaxial CM casting process according to this invention. In this phase, the axial plungers 64 and 66 are in the process of being retracted by compressed air to dispose said plungers 64 and 66 inside the walls of the mold cores 49 after completion of the block compression phase of the process described above with reference to FIG. 9 (and FIG. 8).

Reference is now made particularly to FIG. 11 which is a schematic illustration similar to FIG. 10 but shows another subsequent phase of apparatus operation to carry out the biaxial CM block casting process of this invention. In this phase, the axial plungers 64 and 66 are fully retracted to within the side walls of the mold cores 49, whereby the compressed CM material formed into CM block **30*b* having three web openings 40 can be and is stripped from the cavity of mold 52 by simultaneous downward motion of the compression/stripper shoe 56 and bottom pallet 60**.

Reference is now made particularly to FIG. 12 which is a schematic illustration of various apparatus components shown in FIG. 11, but shows still another subsequent phase of apparatus operation to carry out the biaxial CM casting process according to this invention. In this phase, the compression/stripper shoe 56 returns upward past the mold core assemblies 42 and 44 and their axial plungers 64 and 66 which are retracted within the side walls of the mold cores 49, while the newly made biaxially cast CM block 30b is being ejected on its individual pallet 60 onto a conveyor.

After the compression/stripper shoe 56 moves upwardly out of and above the mold 52 the above-discussed steps of FIGS. 6 through 12 then may be and are repeated to carry out the next cycle for molding the next CM block **30*b* in like manner as described above with reference to FIGS. 6 through 12 in light of FIGS. 13–17** and description thereof further amplified below.

Reference is now made particularly to FIG. 13, together with FIGS. 14–17, for further detailed description of the biaxial CM mold core system generally indicated at 41, the like mold core assemblies generally indicated at 42 and 44, and the core bar and mounting assembly generally indicated at 46. The core bar assembly and mounting system includes a conventional-type commercially available core bar assembly comprising an elongated core bar 72 which has a configuration as shown in FIGS. 13–15 and is welded to the top end walls 45 of each of mold cores 49 (core bar 72 is usually made from high strength steel about one-half inch thick). Core bar 72 has a pair of mounting brackets 74 welded to its ends and extending perpendicular to the longitudinal axis of core bar 72. Each of mounting brackets 74 is provided with a pair of holes 75 for receiving four machine screws 76 to lock the CM mold core system 41 in place within mold box 52 to provide a biaxial CM casting mold for carrying out the biaxial CM casting process according to the present inventions.

Reference is now made particularly to FIG. 13 (and also FIGS. 14 and 17). As previously noted, mold cores 49 are like conventional commonly available mold cores for commercially available CM casting machines excepting that mold cores 49 are modified by cutting axially aligned circular apertures 59 in opposite sides 53 and **53*a* of each mold core 49. It is noted that, like in conventional mold cores, the sides 51, 53 and 53*a* of mold core 49 are disposed at a slight angle toward the central longitudinal axis of mold core 49 whereby the bottom edge of each of said mold core walls at the bottom opening 57 of mold core 49 is disposed a slight distance closer to said central longitudinal mold core axis than the top portion of said side walls of mold core 49 which join with the top end walls 55 thereof. For example (as in a typical conventional mold core), the bottom edges of said side walls of each mold core 49 will be each disposed closer to the mold core's longitudinal central axis than the top edges of said side walls by about one-eighth inch. The sides of each mold core 49 (like in conventional mold cores) are disposed at such a slight angle to the mold core's central axis to facilitate stripping of the compressed CM block such as shown at 30*b* in FIGS. 5A (or block 30*a* of FIGS. 2–5**) after compression of the CM block so as to more readily remove the newly formed CM block from the mold and the casting machine.

Reference is now made especially to FIG. 13 (and FIGS. 16–17) for detailed description of mold core assemblies generally indicated by numerals 42 and 44. As previously noted, for convenience in disclosure of the invention herein, mold core assemblies 42 and 44 are the same in construction and mode of operation, but mold core assembly 42 is shown at the left of FIG. 13 with plungers 64 and 66 thereof extended, whereas mold core assembly 44 is shown at the right of FIG. 13 with plungers 64 and 66 retracted. It also is noted that, for convenience in disclosure of the invention herein, certain features of said like mold core assemblies 42 and 44 are shown in the mold core assembly 42 at the left of FIG. 13 but are not shown in the mold core assembly 44 at the right of FIG. 13, and vice versa. (Features within the scope of the preceding sentence are noted in description of mold core assemblies 42 and 44 with reference to FIG. 13.) It is further noted that, for convenience of disclosure of the invention herein, some features of each of like mold core assemblies 42 and 44 are shown in the section drawings of FIG. 13 in the same plane, whereas in actual construction some such features are not in the same plane but are angularly or otherwise displaced with respect to the longitudinal axis of cylindrical assembly sleeve 62. (Features within the scope of the preceding sentence are noted in description of mold core assemblies 42 and 44 with reference to FIG. 13.)

Still referring especially to FIG. 13, there is centrally disposed within cylindrical assembly sleeve 62 an elongated cylindrical manifold member generally indicated at 78 which extends through the central aperture of an annular-shaped ring generally indicated at 80. Ring 80 supports manifold member 78 and its related components; manifold 78 and ring 80 are in turn supported within the cylindrical assembly sleeve 62 (sometimes called "assembly cylinder 62" or "plungers assembly cylinder 62"). When assembled, cylinder 62, cylindrical manifold member 78 and annular-shaped manifold supporting ring 80 have substantially coincident longitudinal central axes.

Referring especially to like mold core assemblies 42 and 44 in FIG. 13, the annular manifold support ring 80 is secured to the assembly cylinder 62 in the interior thereof by a plurality of machine screws like 81 extending through apertures like 82 in the wall of assembly cylinder 62 and respectively threaded into a plurality of drilled and threaded holes like 84 which extend radially into annular ring 80 from its outer periphery. In a typical embodiment, annular ring 80 is secured to assembly cylinder 62 by three similar machine screws like 81 which are threaded into three similar holes like 84 as shown in FIG. 13, and are located in the same plane normal to the longitudinal axis of assembly cylinder 62 and annular ring 80; and each of the other two screws like 81 are spaced at an angle of 90 degrees from screw 81 shown in FIG. 13 (such other two screws are not shown in the drawing).

Still referring to FIG. 13 (and especially to the mold core assembly 42 at the left of that figure for convenient description), manifold member 78 which extends through and is supported in the central aperture 83 of annular ring 80 also is laterally secured to ring 80 by a pair of like retaining rings 86 held in circular recessed grooves extending into the outer periphery of manifold member 78 on opposite sides of manifold support ring 80. The manifold member 78 is provided at each of its opposite ends with a reduced diameter hub 85 which is externally threaded at 85*a*. An annular stationary piston member generally indicated at 87 is secured to each of the opposite ends of manifold member 78 by means of threads in the central aperture 88 of piston members 87 mating with threads 85*a* on each of hubs 85 at the opposite ends of manifold member 78. Each stationary piston member 87 is provided on its outer cylindrical periphery with an annular recessed groove 89 in which there is mounted any suitable commercially available annular sealing ring (or rings) shown at 90. Each stationary piston member 87 also is provided on its outer cylindrical periphery with an annular flanged section 91 which has an annular planar end 92 disposed perpendicular to the longitudinal axis of cylindrical stationary piston 87. The axis of stationary piston 87 is coincident with the above-described axes of assembly cylinder 62, ring 80, and manifold member 78.

Still referring to FIG. 13 (and especially to the mold core assembly 42 at the left thereof for convenient description), it is noted that cylindrical axial plungers 64 and 66 in each of mold core assemblies 42 and 44 are of like configuration excepting that axial plungers 66 are longer than axial plungers 64 in the direction of their longitudinal axis. Also axial plungers 64 and 66 are mounted on their respective coacting stationary pistons 87 in the same way and operate in relation thereto in like manner as herein described. Each axial plunger 64 is provided with an internal hollow cylindrical portion 93, and each axial plunger 66 is provided with an internal hollow cylindrical portion 93*a* which is like said portion 93 of axial plunger 64 excepting that 93*a* is longer than 93. The open end of each of cylindrical portions 93 and 93*a* of axial plungers 64 and 66 is provided with an internal cylindrical step section 94 which in turn is provided with an internally recessed annular groove 95 near the open ends of hollow cylindrical portions 93 and 93*a* of axial plungers 64 and 66 respectively. An annular ring 96 is mounted in internally stepped section 94 of each of axial plungers 64 and 66; and each said annular ring 96 is secured with one flat side thereof abutting annular face surface 92 on the end of cylinder flange portion 91 of each stationary piston 87, by means of retaining rings 97 disposed in said annular grooves 95. Each of said annular rings 96 is provided with a groove 98 on its exterior cylindrical surface and with a groove 99 on its interior cylindrical surface 97; and suitable commercially available sealing rings 100 are mounted in each of said grooves 98 and 99.

Still referring to FIG. 13 (and especially to mold core assembly 42 at the left thereof for convenient description), annular grooves 102 are provided adjacent opposite ends of each assembly cylinder 62 in the interior cylindrical surface 103 of cylinder 62. Sweeper gaskets 104 are provided in each of said grooves 102 and each gasket engages the exterior cylindrical surface of associated axial plungers 64 and 66. Referring now also to FIGS. 9–11, sweeper gaskets 104 are made of any suitable commercially available material and size so that when plungers 64 and 66 have been extended and exposed to CM mix 70 as shown in FIG. 9, and said plungers are then retracted to inside the mold cores 49 as shown in FIGS. 10 and 11, the sweeper gaskets 104 will wipe particles of CM mix off the cylindrical exteriors of plungers 64 and 66.

At least the exterior of axial plungers 64 and 66 including their respective ends 65 and 67 are coated with a sufficient thickness of a commercially available hard and abrasion-resistant chromium-steel alloy or like suitable material. (As a practical matter, such alloy coating is generally applied electrochemically whereby all surfaces of axial plungers 64 and 66 will be thus coated with such metal alloy.) At least the interior surface 103 of each assembly cylinder 62 and the outer edge surface 105 thereof are similarly coated with an adequate thickness of a commercially available hard and abrasion-resistant metal such as chromium-steel alloy or like suitable material.. (Again, for practical production reasons all surfaces of the assembly cylinder 62 may be coated with such metal alloy.) The commercially available alloy (or alloys) used for coating the interior surface 103 of assembly cylinder 62 and the exterior surfaces 106 of axial plungers 64 and 66 is not only selected for quality of hardness and resistance to abrasion, but is also selected for anti-galling properties so as to provide a self-lubricating effect between said surfaces of assembly cylinders 62 and axial plungers 64 and 66. By specially coating cylindrical assembly sleeve 62 and plungers 64 and 66, as above-discussed, the axial plungers sub-assembly generally indicated at 45 (comprising assembly sleeve 62, annular ring 80, elongated manifold member 78, stationary piston 87, axial plungers 64 and 66, and related components described with specific reference to FIG. 13) will generally have a useful life of three to five times the useful life of core members 49 in typical commercial operations using biaxial CM casting apparatus and method inventions disclosed herein. Therefore, the axial plunger subassembly 45 may be made and sold by commercial sources differing from the commercial sources providing the core bar assembly 46 which will usually also supply the mold cores 49.

Referring now particularly to FIGS. 13 and 16, each of like manifold members 78 of mold core assemblies 42 and 44 is provided with a pair of drilled holes 108 and 109 extending longitudinally through manifold member 78 from end to end, spaced from and substantially parallel to the axis of member 78. Each manifold member 78 is also provided with a pair of drilled holes 110 and 112 extending inwardly from the outer periphery of manifold member 78 so that hole 110 intersects said longitudinally extending hole 108 in manifold member 78, and hole 112 intersects longitudinally extending hole 109 in manifold member 78. Also each manifold member 78 is provided near each opposite end thereof with a pair of drilled holes 114 and 116 extending inward from the outer periphery of manifold member 78 and intersecting said longitudinally extending hole 108 in each manifold member 78. Also, the opposite ends of hole 108 in each manifold member 78 (but not hole 109 thereof) are sealed by plugs shown at 113 in mold core assembly 42 at the left of FIG. 13. Referring especially now to mold core assembly 42 at the left of FIG. 13, said holes 114 and 116 are located adjacent each of stationary pistons 87 at the opposite ends of manifold member 78 so that compressed air will pass from end-sealed manifold hole 108 through holes 114 and 116 to the sealed-off space 118 between the stationary piston 87 and the sealed annular ring 96 secured to each of axial plungers 64 and 66. As a result, compressed air injected into the sealed-off spaces 118 via manifold hole 108 and said holes 114 and 116 will apply positive force to axial plungers 64 and 66 causing them to move from the extended position shown in mold core assembly 42 at the left of FIG. 13 to the fully retracted position of plungers 64 and 66 shown in the mold core assembly 44 at the right of FIG. 13. To cause plungers 64 and 66 to extend, compressed air injected via manifold member hole 109 through the open ends thereof into spaces 117 and 119 of plungers 64 and 66 will apply positive force to the axial plungers 64 and 66 causing them to move from retracted position shown in mold core assembly 44 at the right in FIG. 13 to the fully extended position of plungers 64 and 66 shown in the mold core assembly 42 illustrated at the left of FIG. 13.

Still referring particularly to FIGS. 13 and 16, a top portion of ring 80 is milled to provide a recessed cavity 120 having a bottom surface 122 which will be disposed substantially horizontally when the plungers sub-assembly 45 is assembled in mold core 49. A pair of holes **110*a* and 112*a* are drilled in ring 80 inwardly from surface 122 of recess 120 in ring 80 so that when each ring 80 is assembled on its associated manifold member 78, said hole 110*a* in ring 80 is a continuation of hole 110 in member 78 and said hole 112*a* in ring 80 is a continuation of hole 112 in member 78. Each cylindrical assembly sleeve 62 is provided with drilled holes 110*b* and 112*b* which are respectively substantially axially aligned with said holes 110+110*a* and 112+112*a*. The top wall 55 of each mold core 49 is provided with drilled holes 110*c* and 112*c* which are disposed substantially vertically above holes 110*b* and 110*c* in cylindrical assembly sleeve 62. It is noted that holes 110*c* and 112*c* are located on opposite sides of core bar 72**.

Referring now to FIG. 13 and FIGS. 14–15, an air coupling block 124 is welded or otherwise secured to core bar 72 above holes **110*c* and 112*c* in mold core 49 of mold core assembly 42; and an air coupling block 126 is similarly secured to core bar 72 above holes 110*c* and 112*c* in mold core 49 of mold core assembly 42. Metal tubes 128 of suitable material and size for conducting compressed air are disposed on opposite sides of core bar 72 and tubes 28 are connected at one end by press-fit or in other suitable manner to air passage holes 130 and 134 drilled in air coupling blocks 124 and 126 respectively. Each of air tubes 128 extends through hole 112*c* in top plate 55 of one of mold cores 49 and through hole 110*b* in one of cylindrical assembly sleeves 62 and has its other end press-fitted in the upper enlarged portion of hole 112*a* in one of annular rings 80. The lower ends of air tubes 128 are also sealed by 0-ring 129 and retainer means 131 disposed in recessed cavity 120 in ring 80 inside assembly cylinder sleeve 62. Thus compressed air fed via each coupling block 124 and 126, respectively, through its associated air tube 128 will pass through hole 110 in manifold member 78 and then via longitudinally extending hole 108 through the open ends thereof to operate axial plungers 64 and 66 so that they will extend as elsewhere herein explained. Similar metal tubes 132 for conducting compressed air are disposed on opposite sides of core bar 72, and tubes 132 are suitably connected at one end to air passage holes 135 and 143 drilled in each of air coupling blocks 124 and 126 respectively. Each metal tube 132 extends through a hole 110*c* in top plate 55 of each mold core 49 and hole 110*b* in associated cylindrical assembly sleeve 62; and each tube 132 has its other lower end press-fitted in the upper enlarged portion of step hole 110*a* in annular ring 80. The lower ends of each of air tubes 132 are also sealed by an 0-ring (like 0-ring 129) and said retainer means 131 disposed in recessed cavity 120 in ring 80 inside assembly cylinder sleeve 62. Thus compressed air fed via air coupling blocks 124 and 126 respectively through tubes 132 will pass through hole 110 into longitudinally extending end-plugged hole 108 of each manifold member 78 to operate axial plungers 64 and 66 so that they will retract as elsewhere herein explained. Retainer means 131 for 0-rings 129 is a plate secured in recess 120 in ring 80 by a plurality of screws (not shown) which are threaded into holes extending inwardly into ring 80 from the bottom of 122 of recess 120** (holes not shown).

Air coupling block 124 is provided with another drilled hole 136 perpendicular to and intersecting hole 130 therein and also extending through to the other side of block 124. Air coupling block 124 is provided with still another hole 138 drilled therein perpendicular to and intersecting hole 135 in block 124 and also extending to the other side of the block 124. The other air coupling block 126 is provided with a hole 140 drilled therein perpendicular to and intersecting hole 134 to form an air conduit therewith. Air coupling block 126 is also provided with another hole 142 drilled therein extending normal to and intersecting the hole 143 drilled in block 126 to provide an air conduit therethrough. An air tube 148 is similarly suitably connected at opposite ends thereof to the air hole 136 drilled in air coupling block 124 and to the air hole 140 drilled in air coupling block 126. Also, an air tube 150 is suitably connected at one of its ends to the other end of hole 138 in air coupling block 124, and the opposite end of air tube 150 is suitably connected to air hole 142 in air coupling block 126. Air tubing 144 is connected to a source of constant pressure compressed air through a suitable commercially available three-way valve or like suitable means **48*v*, and is press-fit or otherwise suitably connected at one end in hole 136 in air coupling block 124. Air tube 146 is similarly connected to a constant pressure compressed air source and suitable commercially available three-way valve or like suitable means 48***v*, and is press-fit or otherwise suitably connected in the slightly enlarged end of hole 138 in air coupling block 124.

When the compressed air control means such as a three-way valve 48*v* is operated to provide compressed air to conduit 144 from a conventional compressed air source by suitable conventional means like a three-way valve, the compressed air will be supplied at the same time to both axial plunger subassemblies 45 of mold core assemblies 42 and 44 since they are connected in parallel to the compressed air source via conduit 144 whereby the plungers 64 and 66 of mold core assemblies 42 and 44 will simultaneously be extended outwardly to the position shown in mold core assembly 42 at the left of FIG. 13 and in FIGS. 7, 8 and 9. More specifically, compressed air from conduit 144 passes to conduit 128 of mold core assembly 42 and simultaneously to conduit 128 of mold core assembly 44 via tubing 148 interconnecting air couplings 124 and 126. The compressed air passes simultaneously via tubes 128 to and through holes 112*a* in ring 80 and 112 in manifold 78 and then through longitudinally extending hole 109 in manifold 78 and out through the open ends of hole 109 into the inside portions 117 and 119 of axial plungers 64 and 66, respectively, causing said plungers to extend under the positive force exerted thereon by compressed air in the manner described. When the compressed air control means such as a three-way valve 48*v* is alternatively operated to provide compressed air to conduit 146, compressed air will be provided at the same time to each of mold core assemblies 42 and 44 simultaneously. In this case, the compressed air from conduit 146 passes via air coupling block 124 to and through tube 132 to mold core assembly 42, while compressed air simultaneously passes from conduit 146 via air coupling 126 through tubing 150 and air coupling 126 and through air tubing 132 to mold core assembly 44, whereby plungers 64 and 66 will simultaneously be retracted to the position shown in mold core assembly at the right in FIG. 13 and in FIGS. 6, 11 and 12. More specifically, the compressed air simultaneously provided through tubing 132 to each of mold core assemblies 42 and 44 passes through holes 110*a* in ring 80 and hole 110 in manifold member 78 and then into and through the end-plugged longitudinally extending hole 108 in manifold member 78, and thence through laterally extending passages 114 and 116 into the spaces 118 behind stationary pistons 87 so as to apply a force which positively and simultaneously retracts all of plungers 64 and 66 in both of the mold core assemblies 42 and 44.

Referring particularly to FIGS. 13 and 17, the bottom portion of each assembly sleeve 62 and annular ring 80 in each of mold core assemblies 42 and 44 is provided with a pair of communicating slots shown at 152 so as to provide an air passage from the inside to the outside of assembly sleeve 62 in communication with the inner portions of axial plungers 64 and 66 disposed on opposite sides of ring 80 in each of mold core assemblies 42 and 44. Such slots 152 provide passages for venting of air from inside sleeve 62 and relief of pressure when the axial plungers are operated as herein explained to cause axial plungers 64 and 66 to move from the extended position shown in mold core assembly 42 at the left of FIG. 13 to the retracted position shown in mold core assembly 44 at the right of FIG. 13.

Referring particularly to FIG. 13, a hole 154 is drilled in the cylindrical wall of each of the longer axial plungers 66 with said hole 154 having its axis parallel to the axis of plunger 66; and a smaller vent hole 156 is provided at the end of hole 154 extending to the outer end surface 67 of each of plungers 66. Like holes 154*a* and 156*a* are drilled in the cylindrical wall of each of the shorter axial plungers 64. In each of mold core assemblies 42 and 44, a cylindrical pin 158 is mounted at one end on annular support ring 80 in any suitable manner, e.g., by the end of pin 158 being threaded and secured in a threaded hole in ring 80 (see mold core assembly 42 at the left of FIG. 13). The axis of pin 158 is substantially perpendicular to ring 80 and also is coincident with the axis of holes 154,156; and the diameter of pin 158 is less than the inside diameter of hole 154. Thus, air may be vented through holes 154,156 when axial plunger 66 is retracted from the extended position shown in mold core assembly 42 at the left of FIG. 13 to the retracted position shown in mold core assembly 44 at the right of FIG. 13. The pins 158 have an outer diameter also less than the inner diameter of outer holes 156 at the ends of holes 154 in axial plungers 66 so that the ends of pins 158 will extend into holes 156 and thereby clear from said holes any particles of CM mix 70 which may have entered holes 156 during any of the biaxial CM block casting steps shown in any one or more of FIGS. 8–11 described above. Similar but shorter pins 158*a* are similarly mounted on opposite sides of ring 80 in each of mold core assemblies 42 and 44, and pins 158*a* extend into apertures 154*a* in the sides of axial plungers 64, with the ends of pins 158*a* extending into end apertures 156*a* when the shorter axial plungers 64 are fully retracted. Pins 158*a* coact with holes 154*a*,156*a* in the shorter axial plungers 64 to vent air when plungers 64 are retracted and also to displace any particles of CM mix 70 which may become lodged in the end holes 156*a*, in like manner as explained above with reference to longer pins 158 and holes 154,156 of longer axial plungers 66. (It is noted that while only pin 158 in mold core assembly 42 is shown mounted on ring 80, it will be apparent from the foregoing discussion that all pins 158 and 158*a* in mold core assemblies 42 and 44 are similarly mounted on opposite sides of rings 80 in both mold core assemblies 42 and 44.

Referring now to FIGS. 9 and 10 plus 13, after the CM mix 70 is compressed and vibrated to form the CM block 30*b* as shown in FIG. 9 and retraction of plungers 64 and 66 is started as shown in FIG. 10, there will be resultant substantial negative pressure and vacuum effect between (i) the ends 67 of longer axial plungers 66 and the sides 54 of the mold box 52 and (ii) between the two abutting ends 65 of the shorter axial plungers 64. The holes 154,156 in the longer axial plungers 66 and the holes 154*a*, 156*a* in the shorter axial plungers 64 serve to break such negative pressure and vacuum effect between the ends 67 of plungers 66 and mold walls 54 and between the abutting ends 65 of the plungers 64 when said plungers start to retract as illustrated in FIG. 10. Also, when the plungers 64 and 66 are being fully retracted after completion of the step shown in FIG. 10 and before start of the step shown in FIG. 11, the ends of pins 158 and 158*a* will respectively extend into holes 156 of plungers 66 and into holes 156*a* of plungers 64 to dislodge particles of CM mix therefrom and thereby clean the ends of holes 154,156 and 154*a*,156*a*.

Referring now particularly to mold core 42 at the left of FIG. 13 and also to FIG. 17, each of biaxial plunger subassemblies 45 of each of mold core assemblies 42 and 44 is mounted in its associated mold core 49 by a bracket 160 having a relatively elongated main section 162 and two legs 164 extending substantially perpendicular from section 162 as will be apparent from said Figures. The elongated portion 162 of bracket 160 is secured to a bottom portion of assembly sleeve 62 by a pair of screws 166 extending into threaded apertures 168 in the main portion 162 of bracket 160. Each leg 164 of bracket 160 is provided with a threaded aperture 170 which receives a threaded screw member 172 which is provided with a slot 174 (or equivalent means) to enable turning of screw 172 in threaded aperture 170. A nut 176 is screwed onto the threads of screw 172 on the inside of bracket legs 164 as shown in said Figures. After the biaxial plunger sub-assemblies 45 are mounted in apertures 59 in the walls 53 and **53*a* of mold core assemblies 42 and 44, respectively, bracket 160 is secured to the assembly sleeve 62 by means of screws 166 threaded into holes 168, and then the screws 172 plus nuts 176 are adjusted in relation to bracket legs 164 and side walls 53 and 53*a* of the mold core 49 so as to finalize the location of each biaxial plunger sub-assembly 45 in relation to side walls 53 and 53*a* of mold cores 49 and to secure each bracket 160 firmly in relation to its mold core 49. Each respective biaxial plunger sub-assemblies 45 is thus secured by like bracket means in like manner to the associated mold core 49 of each mold core assembly 42 and 44. It is noted that the slots indicated at 152 cut in the underside of each of assembly cylinders 62 and the lower opposite sides of each annular ring 80 (as shown in FIGS. 13 and 17) will extend laterally beyond the sides of the mounting bracket 160 as shown particularly in FIG. 17 so as to permit the venting of air from the inside of each cylindrical sleeve 62 to relieve pressure therefrom particularly when the axial plungers 64 and 66** are retracted, as above discussed.

Reference is now made particularly to FIGS. 13, 16 and 17. Suitable air tubing of metal or the like generally indicated at **178*c* is connected to the compressed air source by means of a suitable commercially available pressure reduction device 48*v* whereby air is fed at a low pressure through tubing 178*c* and via air couplings 124 and 126 to and through tubing 178 to each of mold core assemblis 42 and 44. The flexible tubing 178 suitably connected to and extending from the outlet end of air couplings 124 and 126 is passed through an aperture 180 in the top end surfaces 55 of each of mold cores 49, is "snaked" around the assembly cylinder 62 in each of mold core assemblies 42 and 44, and is connected in series to a pair of nipples 184 which are threaded in apertures in each assembly cylinder 62 so that air will pass through flexible tubing 178 to the inside of cylinders 62 of each mold core assembly 42 and 44. See especially mold core assembly 44 at the right in FIG. 13 and both mold core assemblies 42 and 44 shown in FIG. 17. Flexible tubing 178 is connected by nipples 184 in like manner to both mold core assemblies 42 and 44 and operation thereof is the same for both assemblies 42 and 44. When the axial plungers 64 and 66 of the mold core assemblies 42 and 44 are retracted during biaxial CM block casting process in the steps illustrated in FIGS. 10 and 11, it is necessary to assure that all axial plungers 64 and 66 are fully retracted so that all parts thereof are totally disposed inside of walls 53 and 53*a* of the mold cores 49 as shown at the right of FIG. 13 and in FIG. 11 before the CM block 30*b* is stripped from the mold 52 by the compression/stripper shoe as shown in FIG. 11. The nipples 184 connected to flexible air lines 178 are located so that the aperture in each nipple 184 extending to the inside of assembly sleeve 62 will be blocked off by the "inner ends" of axial plungers 64 and 66 when those plungers are in fully retracted position, as shown particularly in mold core assembly 44 at the right of FIG. 13. The nipples 184 in cooperation with their associated air lines 178 serve as "air sensors" for axial plungers 64 and 66 in each of mold core assemblies 42 and 44 to determine whether each and all said plungers 64 and 66 are fully retracted to inside mold core 49 as shown in mold core assembly 44 at the right of FIG. 13. That is because if all said axial plungers 64 and 66 are fully retracted there will result a sufficient pre-determined back pressure (e.g., 5 psi or the like) which is measured by a suitable commercially available pressure gauge 48*g* that is connected to the low pressure line 178*c* on the input side of air coupling 124 and is mounted on CM casting machine 48 where it can be conveniently observed by the machine operator. Thus, if such back pressure via nipples 184 and air lines 178,178*a* is above a predetermined psi level, that indicates that the axial plungers 64 and 66 are fully retracted so that the CM block casting operation can be continued. On the other hand, if all the axial plungers 64 and 66 are not fully retracted, air will pass via air lines 178 through nipples 184 into assembly cylinders 62 and out of vents 152 in the underside thereof; and this will cause a low and insufficient back pressure reading at the pressure gauge 48*g* in line 178*c* on the input side of air coupling 124, thereby indicating that one or more of axial plungers 64 and 66 are not sufficiently retracted. The machine operator can then intervene to put matters aright by manual operation. Further, such "air sensor" arrangement for determining full retraction of plungers 64 and 66 by means of nipples 184 and air lines 178,178*a* is also used (i) to discontinue operation of the casting machine 48 if any axial plungers 64 and 66 are not fully retracted or (ii) to permit continued operation of the CM casting machine 48 if the axial plungers 64 and 66** are fully retracted, as further described below.

Referring to FIG. 15, the portion of conventional CM casting machine 48 shown in that drawing is made from a press-through of a photograph of a Columbia Machine Model 5 made by Columbia Machine, Inc., located in Vancouver, Wash. ("Columbia"). This model Columbia machine makes one block at a time, at the rate of one block about every six seconds. Columbia, however, also makes similar CM casting machines operating in similar manner but which can produce three, six or even 12 CM blocks at a time (a three-block casting machine is believed most commonly used in the U.S.A. CM block making industry). Such Columbia machines, exemplified by Columbia Machine Model 5, have both a manual and automatic cycle operating mode. For the automatic cycle operating mode, the casting machine has a control panel incorporating electromechanical control circuitry to operate the machine in a conventional cycle. In a conventional CM block casting process, conventional mold cores similar to cores 49 but having four planar side walls would be used in a conventional manner well known in the art. The control circuitry of casting machine provides a logic pattern for conventional CM casting whereby: (1) the compression/stripper shoe 56 is lifted upwardly above the level of the feed tray 58 and a pallet 60 is raised to form the bottom of mold 52, analogous to the phase of operation shown in FIG. 6; (2) the feed tray 58 moves in over the mold 52 below the compression/stripper shoe 56, analogous to the phase of operation shown in FIG. 7; (3) CM mix 70 is fed into the cavity of the mold 52 from the feed tray 58, analogous to the phase of operation shown in FIG. 8; (4) the feed tray 58 is laterally withdrawn from over the mold 52 permitting the compression/stripper shoe 56 to come down and compress CM mix 70 in the mold 52 as vibration of mold 52 proceeds by conventional means incorporated in CM casting machine 48, analogous to the phase of operation shown in FIG. 9; (5) the compressed CM material formed into a conventional CM block such as shown at 30 in FIG. 1 is then stripped from the cavity of the mold 52 by simultaneous downward motion of compression/stripper shoe 56 and the bottom pallet 60, analogous to the phase of operation shown in FIG. 11; (6) the compression/stripper shoe 56 returns upward past the mold cores while the newly made conventional CM block 30 is being ejected on its individual pallet 60 onto a conveyor; (7) after the compression/stripper shoe 56 moves upwardly out of and above the mold 52, the above-discussed steps (1) to (6) are then repeated to carry out the next cycle for molding the next conventional block 30 in like manner as just described above herein. Note that in such a conventional CM block casting process there is no step corresponding or analogous to that shown in FIG. 10.

To use the biaxial casting apparatus and process disclosed herein in a conventional Columbia CM casting machine 48, there is provided a suitable commercially available electromechanical control means **48*c* for the suitable commercially available three-way valve 48*v* as part of the compressed air control means so as to alternately supply compressed air from a compressed air source to conduit 144 whereby such compressed air passing through tubing 128 to manifold hole 109 will cause axial plungers 64 and 66 in both mold core assemblies 42 and 44 to extend simultaneously. Also, said electromechanical compressed air control means 48*c* is caused to alternatively operate the three-way valve 48*v* to alternately supply compressed air to conduit 146 and thus via tubes 132 to hole 108 in manifold 78 so as to simultaneously cause retracting of all plungers 64 and 66 in mold core assemblies 42 and 44. The electromechanical control means 48*c* for the three-way valve 48*v* (or other equivalent conventional means) for alternately feeding compressed air from the source to input line 144 (to extend all axial plungers 64 and 66) or to input line 146 (to retract all axial plungers 64 and 66) are appropriately tapped into the electrical control circuitry in the control box 48*c* of the machine 48 to modify the machine's automatic operations logic pattern so as to change the machine's typical above-discussed conventional molding cycle to the biaxial CM casting cycle shown in FIGS. 6–12 and fully described above. Thus the electromechanical means for controlling the three-way valve (or other equivalent means) is tapped into the control circuitry of casting machine 48 to modify its logic whereby: (a) compressed air is fed to line 146 to simultaneously positively retract axial plungers 64 and 66 in both mold core assemblies 42 and 44 as the compression/stripper shoe 56 is raised to above the feed tray 58 and the pallet mold 60 is raised to form the bottom of the mold 52, as shown in FIG. 7; (b) compressed air is then supplied by operation of the three-way valve to input conduit 144 to cause the axial plungers 64 and 66 to be simultaneously positively extended and to remain in such extended position, as shown in FIGS. 7, 8 and 9 for the phases of the biaxial CM casting process shown in said figures and described above; (c) the three-way valve is then switched to supply compressed air to input conduit 146 to cause the axial plungers 64 and 66 to move to simultaneously positively retract after the CM block 30*b* is formed as shown in FIGS. 10 and 11, and to maintain said plungers in fully retracted position within the walls of mold cores 49 as shown in FIG. 11 before the compression/stripper shoe 56 and pallet 60 are permitted or caused to be moved downward to strip the completed CM block 30*b* from the mold 52 as shown in FIG. 11; (d) the compression/stripper shoe 56 is raised up past the mold cores 49 and the fully retracted axial plungers 64 and 66 disposed inside the walls of mold cores 49 while the just-made CM block 30*b* is moved to a conveyor on its pallet 60 and a new pallet 60 is moved in below the mold 52 to provide a new mold bottom; and (e) the CM biaxial mold process and phases thereof shown in FIGS. 6–12** is thereafter repeated.

The portion **178*a* of the low pressure third air line 178,178*a* which extends from the input side of the air coupling 124 is connected to a suitable commercially available pressure gauge 48*g* to indicate to the machine operator whether the back pressure of air at nipples 184 and in lines 178,178*a* is (1) equal to or greater than a predetermined minimum back pressure (e.g., 5 psi), thereby indicating to the operator that the axial plungers 64 and 66 are fully retracted, or (2) is below such predetermined minimum back pressure, thereby indicating to the operator that one or more of axial plungers 64 and 66 are not fully retracted. In the latter case (2), the operator can manually stop the machine 48. However, said line 178*c* is not only connected to such a pressure gauge but also is connected to a pressure-operated switch which is in turn tapped into the control circuitry of the casting machine 48 to operate as a "go-no go" addition to the machine's control system so that after a CM block 30*b* has been formed as shown in FIG. 9, the machine will not proceed with stripping of the block 30*b* and removal of the pallet 60 unless all axial plungers 64 and 66 move to fully retracted position as shown in FIG. 11 and in assembly 44 at the right of FIG. 13. If all axial plungers 64 and 66 are thus fully retracted the thus-modified machine 48 will proceed with the next phase of the block casting cycle involving removal of the CM block 30*b* as shown in FIG. 11, and then automatically proceed with additional CM block making cycles as shown in FIGS. 6–12 as hereinabove described. However, if all axial plungers 64 and 66 are not fully retracted when they should be (as in FIGS. 6 and 11) the thus-modified machine 48 will not proceed with the next phase of the biaxial CM casting process; the operator will then determine and fix the problem using manual operation of machine 48**.

The operating program and logic governing the conventional block-making automatic cycle of machine 48 exemplified by Columbia Machine Model 5 is shown in Columbia drawing No. D-328-30-52-1 titled "Control Schematic, Model 5 Block Machine, Stepper Controlled Oscillation". The aforementioed electromechanical controls for operating the three-way valve **48*v* for alternately supplying air to input conduit 144 to extend all axial plungers 64 and 66 or to input conduit 146 to retract all axial plungers 64 and 66, and the aforementioned pressure-operated switch connected to low pressure input line 178*c* are suitably tapped into the control arrangement shown in said Columbia drawing to modify the logic and operating program governing conventional automatic operation of the casting machine so as to perform automatic operation of the biaxial CM casting process of FIGS. 6–12 as herein disclosed and particularly described with reference to FIGS. 6–12 plus FIGS. 13–17**.

As will be apparent to one skilled in the art in light of the disclosure and detailed explanation herein of the biaxial CM casting apparatus and biaxial CM casting method of the present inventions, although the same are explained by way of example as used in a Columbia Machine Model 5 casting machine having only one mold, such new biaxial casting apparatus can be installed in like manner in commercially available machines having three molds, six molds or even up to twelve molds by using for such multiple molds an equal number of mold core systems generally indicated at 41 including mold core assemblies 42 and 44 and core bar and mounting assembly 46 (see FIGS. 13–14).

It is believed that the construction of the biaxial CM block casting apparatus and its mode of operation and functional results according to the present invention will be clear to one skilled in the art from the disclosure hereinabove, particularly with reference to FIGS. 13–17 and detailed discussion thereof. It is also believed that the mode of operation of biaxial CM casting process according to the present inventions and functional results according to the present inventions also will be fully apparent from the detailed description hereinabove with reference to FIGS. 6–12 in conjunction with FIGS. 13–17.

Reference is now made to FIGS. 18 and 19 which schematically show modified embodiments of above-described mold core assemblies 42 and 44 that are indicated generally at **42*b* and 44*b*. Components of the modified embodiment shown in FIGS. 18–19 which are the same as corresponding components of the embodiment shown in FIGS. 13–17 plus FIGS. 6–12 are identified by like numerals. Components of the modified embodiment of FIGS. 18–19 which are similar to but changed from components of the embodiment shown in FIGS. 13–17 plus FIGS. 6–12 are identified by the same numerals as used in FIGS. 13–17 and 6–12** plus the letter "b".

Mold core assembly **44*b* in the embodiment of FIGS. 18 and 19 is constructed and operated in the same way as mold core assembly 44 shown at the right of FIG. 13, excepting that mold core assembly 44*b* has an axial plunger 64*b* plus an axial plunger 66. The axial plunger 66 in the modified mold core assembly 44*b* is the same as axial plunger 66 in mold core assembly 44 shown in FIG. 13. The axial plunger 64*b* of the embodiment in FIGS. 18–19 is like the axial plunger 64 in mold core assembly 44 shown in FIG. 13; but axial plunger 64*b* of the embodiment as shown in FIGS. 18–19 is longer than inner axial plunger 64 in the mold core assembly 44 shown in FIGS. 13–17 and diagrammatically illustrated in FIGS. 6–12. The inwardly disposed axial plunger 64*b* of mold core assembly 44*b* is sufficiently longer than the inwardly disposed axial plunger 64 of core mold assembly 42 in FIG. 13 so that when plunger 64*b* is extended the end 65*b* thereof will engage the wall 53*b* of the mold core 49*b* of mold core assembly 42*b*. Thus extended plunger 64*b* will provide a cylindrical end section of plunger 64*b* which spans the space between wall 53*a* of mold core assembly 44*b* and wall 53*b* of mold core assembly 42*b* as shown in FIG. 19—in a manner comparable to the abutting ends 65 of extended plungers 64 of mold core assemblies 42 and 44 as shown in FIGS. 7–9 (which are analogous to FIG. 19). The mold core assembly 42*b* in the embodiment of FIGS. 18–19 is similar to the mold core assembly 42 of the embodiment of FIGS. 13–17 and FIGS. 6–12 in that mold core assembly 42*b* has an axial plunger 66 which is the same in construction and mode of operation as the axial plunger 66 of the mold core assembly 42 shown in FIGS. 13–17 and FIGS. 6–12. However the modified embodiment of mold core assembly 42*b* shown in FIGS. 18–19 differs from the mold core assembly 42 in FIGS. 13–17 (and illustrated in FIGS. 6–12) in that mold core assembly 42*b* in the embodiment of FIGS. 18–19 has a planar wall 53*b* (without any apertures such as shown at 59 in wall 53*a* of mold core assembly 42 at the left of FIG. 13). The mold core assembly 42*b* is built analogously to mold core 42 (and mold core 44) described above in detail with reference to FIGS. 13–17; but the manifold member in mold core assembly 42*b* corresponding to manifold 78 of mold core assembly 42 (and 44) is built with only one stationary piston such as shown at 87 at the left in mold core assembly 42 in FIG. 13 and with only one axial plunger 66 (like plunger 66 in mold core assembly 42 in FIG. 13). The air supply arrangement for the mold core assembly 44*b* in the embodiment of FIGS. 18–19 is like that for the mold core assembly 44 described above with reference to FIGS. 13–17. However, in the embodiment of FIGS. 18–19 the manifold in mold core assembly 42*b* corresponding to manifold 78 in mold core assembly 42 (at the left of FIG. 13) is modified to provide only air conduits for operation of the single axial plunger 66 in mold core assembly 42*b*. The air supply means for the mold core assembly 42*b* are generally similar to those for the mold core assembly 42 at the left of FIG. 13. However, such air supply means for mold core assembly 42*b* are connected to only one set of holes in ring 80 and associated holes in the modified manifold to actuate the single plunger 66 to extend outwardly and retract inwardly (similarly to operation of plunger 66 of the mold core assembly 42 at the left of FIG. 13). Further only one nipple 184 is connected to the outer axial sleeve 62 of mold core assembly 42*b* and connected to a flexible air line 178, with nipple 184 disposed adjacent the end of axial plunger 66 of mold core assembly 42*b* when said plunger 66 is in fully retracted position so as to operate as an "air sensor" to indicate full retraction of the axial plunger 66 of mold core assembly 42*b* in a manner like that described above with reference to mold core assembly 42 (and mold core assembly 44) in the embodiment of FIGS. 13–17 also illustrated in FIGS. 6–12**.

FIG. 18 shows the embodiment of FIGS. 18–19 with the axial plungers 66 and **64*b* fully retracted similarly to retraction of plungers 64 and 66 in the phase of operation shown in FIG. 6 for the embodiment of FIGS. 13–17 (and also analogous to the phases of operation shown in FIGS. 11 and 12 for the embodiment of FIGS. 13–17). The embodiment of FIGS. 18–19 is shown in FIG. 19 with the axial plungers 66 and 64*b* in extended position similarly to extension of plungers 64 and 66 shown in FIG. 7 for the embodiment of FIGS. 13–17 (and also analogous to extended position of said plungers for the phases of operation shown in FIGS. 8 and 9 for the embodiment of FIGS. 13–17**).

It is believed that the construction of modified biaxial CM casting apparatus incorporating modified mold core assemblies **42*b* and 44*b* of FIGS. 18–19, and the mode of operation and functional results thereof according to the present invention will be clear to one skilled in the art from the disclosure herein particularly in light of the detailed disclosure of FIGS. 13–17 and FIGS. 6–12. It is also believed that the mode of operation of biaxial CM casting process using the modified apparatus embodiment of FIGS. 18–19 according to the present invention and functional results thereof also will be fully apparent to one skilled in the art from the disclosure herein particularly in light of the detailed description with reference to FIGS. 6–12 of the apparatus embodiment of FIGS. 13–17**.

It is noted that use of the embodiment of FIGS. 13–17 incorporating two like mold core assemblies 42 and 44 particularly shown in FIGS. 13–15 each having two axial plungers 64 and 66 is preferable to the modified embodiment of FIG. 18–19 for purposes of economical volume production of such mold core assemblies due to the greater commonality of parts of the mold core assemblies 42 and 44 of the embodiment of FIGS. 13–17 as compared to the mold core assemblies **42*b* and 44*b* of the embodiment of FIGS. 18–19. However, the above-described embodiment of FIGS. 18–19** will perform well also.

Reference is now made particularly to FIGS. 20–24 which schematically show another modified embodiment of biaxial CM apparatus and method using modifications of above-described mold core assemblies 42 and 44 that are indicated generally at **42*c* and 44*d*. Components of the modified embodiment shown in FIGS. 20–23 which are the same as corresponding components of the embodiment shown in FIGS. 13–17 or FIGS. 18–19 (and FIGS. 6–12) are identified by like numerals and letters. Components of the modified embodiment of FIGS. 20–24 which are similar to but changed from components of the embodiment shown in FIGS. 13–17 or FIGS. 18–19 (and FIGS. 6–12) are identified by the same numerals as used in FIGS. 13–17 or FIGS. 18–19 (and FIGS. 6–12**) plus the letters "c" or "d".

The biaxial CM block casting apparatus shown in FIGS. 20–23 and the biaxial CM casting process described with reference thereto are used for making a biaxially cast CM "T-block" such as shown in FIG. 24 and described with reference thereto. It is noted the CM T-block shown in FIG. 24 may also be referred to as a "triaxially cast" CM block, and that the CM casting apparatus and method disclosed in and with reference to FIGS. 20–23 may also be respectively called a "triaxial CM casting apparatus" and a "triaxial CM casting method."

Mold core assembly **42*c* in the embodiment of FIGS. 20–23 is constructed and operated in the same way as mold core assembly 44*b* shown at the right of FIG. 19, as described above (with reference to FIGS. 13–17), excepting that mold core assembly 42*c* is inverted left to right compared to mold core assembly 44*b* shown in FIG. 19. The axial plunger 66 in the modified mold core assembly 42*c* is the same as axial plunger 66 in mold core assembly 42 shown in FIG. 13. The axial plunger 64*b* of mold core assembly 42*c* is like the axial plunger 64 in mold core assembly 42 shown in FIG. 13; but axial plunger 64*b* of mold core assembly 42*c* shown in FIGS. 20–23 is sufficiently longer than inner axial plunger 64 in the mold core assembly 44 shown in FIGS. 13–17 so that when plunger 64*b* is extended the end 65*b* thereof will engage the wall 53*d* of the mold core 49*d* of mold core assembly 44*d*. Thus extended plunger 64*b* will provide a cylindrical end section of plunger 64*b* which spans the space between wall 53*a* of mold core assembly 42*c* and has its end 65*b* engaging wall 53*c* of mold core assembly 44*d* as shown in FIGS. 20 and 22, in a manner similar to operation of plunger 64*b* in mold core assembly 42*b* as shown in FIG. 19** and described with reference thereto.

The embodiment of FIGS. 20–23 incorporates a mold core assembly **44*d* which is similar in construction and mode of operation to the mold core assembly 44 of the embodiment of FIGS. 13–17, but modified mold core assembly 44*d* of FIGS. 20–23 differs from mold core assembly 44 of FIGS. 13–17 as follows (referring to FIGS. 20–23 compared to FIGS. 13–17): (1) A modified mold core 49*d* has a pair of opposed spaced planar side walls 53*c* (which do not have circular apertures 59 therein as in mold core assembly 44 of FIGS. 13–15); (2) Modified mold core 49*d* is provided in opposed planar walls 51*d* thereof with aligned circular apertures 59*d*; (3) The mold core sub-assembly (indicated at 45 in FIGS. 13–15) including assembly cylinder 62 (not shown in FIGS. 20–24) is mounted and secured in said apertures 59*d* of mold core 49*d* in like manner as mold core sub-assembly 45 in the embodiment of FIGS. 13–15 as above-described; (4) Thus plungers 66*d* and other related components in their plungers assembly cylinder 62 are disposed (a) perpendicular to like components in mold core assembly 44 in FIGS. 13–15, and (b) perpendicular to like components of mold core assembly 42*c* in the embodiment of FIGS. 20–23; (5) Axial plungers 66*d* are of equal axial length in mold core assembly 44*d* in the embodiment of FIGS. 20–23; and the length of said axial plungers 66*d* is such that when said plungers are fully extended by compressed air means the ends 67 of plungers 66*d* will engage the longer mold box side walls indicated at 54' in FIGS. 25 and 26. [It is noted that longer sides of mold box 52/mold 52 are sometimes indicated by numeral 51' to distinguish said sides from shorter sides 51 of mold box 52/mold 52.]; (6) Dimensions of sleeve 62 and other internal components of mold core assembly 44*d* will be suitably modified consistent with the foregoing. In the embodiment of FIGS. 20–24, the compressed air supply and control arrangement for extending and retracting plungers 66 and 64*b* of mold core assembly 42*c* and plungers 66*d* of mold core assembly 44*d*, plus the air sensors arrangement for assuring full retraction of said plungers, are the same as described above for the embodiment of FIGS. 13–17**.

The compressed air supply means and the air-plunger sensor means for the mold core assemblies **42*c* and 44*d* are similar to those for the respective mold core assemblies 42 and 44 in the embodiment of FIGS. 13–17 as described above with reference to said Figures. The mold cores 42*c* and 44*d* are mounted in like manner as mold core assemblies 42 and 44 of FIGS. 13–17 on a core bar and mounting means such as indicated at 46, 72, 74, 75 in FIGS. 13–15. The compressed air means and air sensor means for mold core assemblies 42*c* and 44*d* are similarly mounted and connected as for assemblies 42 and 44 in FIGS. 13–17, except that some components like nipples 184 are turned 90 degrees for mold core assembly 44*d* in the embodiment of FIGS. 20–24**.

The embodiment of FIGS. 20–24 is shown in FIGS. 21 and 23 with the four axial plungers 66, **64*b* and 66*d* fully retracted similarly to full retraction of plungers 64 and 66 in the phase of operation shown in FIG. 6 for the embodiment of FIGS. 13–17 (and also analogous to the phases of operation shown in FIGS. 11 and 12 for the embodiment of FIGS. 13–17**). The embodiment of FIGS. 20–24 is shown in FIGS. 22 and 24 with the axial plungers 66, 64*b* and 66*d* in extended position similarly to extension of plungers 64 and 66 shown in FIG. 7 for the embodiment of FIGS. 13–17 (and also analogous to extended position of said plungers for the phases of operation shown in FIGS. 8 and 9 for the embodiment of FIGS. 13–77).

It is believed that the construction of modified biaxial CM casting apparatus incorporating modified mold core assemblies 42*c* and 44*d* of FIGS. 20–24, and the mode of operation and functional results thereof according to the present invention will be clear to one skilled in the art from the disclosure herein particularly in light of the detailed disclosure of FIGS. 20–24 plus FIGS. 13–17 and FIGS. 18–19 with reference to FIGS. 6–12. It is also believed that the mode of operation of the biaxial CM casting process using the modified apparatus embodiment of FIGS. 20–24 according to the present invention and functional results thereof also will be fully apparent to one skilled in the art from the disclosure herein particularly in light of the detailed description of FIGS. 20–25 with reference to FIGS. 6–12 plus FIGS. 13–17 and FIGS. 18–19.

Reference is now made particularly to FIGS. 24 and 5A (with reference also to FIG. 1, and FIGS. 2–5). FIG. 24 shows an embodiment of biaxially cast CM "T-block" made by using the above-described biaxial CM casting apparatus shown in FIGS. 20–23 and using a biaxial CM casting method disclosed above with reference to said figures. The T-block made by this modification of biaxial CM casting apparatus and method of FIGS. 20–23 according to the present invention is generally indicated at 30*c* in FIG. 24 and comprises a pair of longitudinally extending face shells 31*c* which are interconnected by laterally extending end web 32*b*, central web 34*a*, and end web 32*c* thereby forming two cavities 35*c* and 35*d* which extend through CM T-block 30*c* from the top to the bottom thereof in the direction of the axis of casting as will be apparent from FIG. 24 with reference to the other figures mentioned (in the first two sentences of this paragraph). The end web 32*b* and the central web 34*a* are each provided with openings 40 which are made by varying the mold cavity during casting and timing such variation of said mold cavity in such a way as to vary the shape of the CM block 30*c* to provide web openings 40 extending in the direction of a second axis normal to the first axis of casting without a secondary manufacturing operation, as herein disclosed. It is noted that end web 32*c* is not provided with such an opening 40 (in contrast to biaxially cast CM block 30*b* shown in FIG. 5A and biaxially cast CM block 30*a* shown in FIGS. (2–5). The biaxially cast CM T-block 30*c* is also provided with two substantially aligned openings 40*d* in opposed portions of the face shells 31*c* in the region of cavity 35*d* of block 30*c*, and said openings 40*d* extend in the direction of a third axis normal to the axis of casting and also normal to said second axis of openings 40 in webs 32*b* and 34*a*. More particularly, said openings 40 in end web 32*b* and central web 34*a* are made by varying the mold cavity during casting and timing such variation by selectively using plungers 66 and 64*b* of the mold core assembly 42*c* in extended and retracted positions as shown in FIGS. 20–23 and above explained. Said openings 40*d* in the face shells 31*c* are made by varying the mold cavity during casting and timing such variation of the mold cavity in such a way as to result in variation of the shape of the CM block 30*c* to provide openings 40*d* extending normal to the axis of casting and also normal to said second axis of web openings 40 without any secondary or tertiary manufacturing operation as explained herein. More particularly, said openings 40*d* in face shells 31*c* are made by selectively timed extension and retraction of the axial plungers 66*d* of mold core assembly 44*d* of the apparatus disclosed in FIGS. 20–23 in the operation of said apparatus to perform the biaxial CM casting method described above with reference to FIGS. 20–23.

Referring again now particularly to FIG. 24, the resultant T-block 30*c* may be joined at its end which has openings 40*d* in face shells 31*c* to a pair of biaxially cast CM blocks 30*b* of configuration such as shown in FIG. 5A at the ends of two CM block wall sections made up of CM blocks like 30*b* (or 30*a*) so that the opening 40 in the end web 32*b* of the adjoining end block 30*b* of one such CM block wall sections will be in communication with an opening 40*d* in one of the two face shells 31*c* of T-block 30*c* and thus also with cavity 35*d* of such block 30. Similarly, the opening 40 in the end web 32*b* of the other adjoining end block 30*b* of the other such CM block wall section will be in communication with the second opening 40*d* in the other face shell 31*c* and thus also with cavity 35*d* of T-block 30*c*. Hence, piping and/or electrical conduits or the like can be extended through openings 40 in any of such CM blocks 30*b* into and through one or both face shell openings 40*d*, cavity 35*d* and web openings 40 of T-block 30*c* and then extended in either direction into the perpendicular intersecting walls made up of biaxially cast CM blocks 30*b* having openings 40 in the end and central webs thereof, as will be apparent to one skilled in the art in light of the showing of CM blocks 30*b* in conjunction with CM T-block 30*c* in FIG. 24 and explanation thereof herein. It also will be apparent that the biaxially cast CM T-block 30*c* used in conjunction with the biaxially cast CM blocks 30*b* as shown in FIG. 24 and herein explained to provide a "T-wall-connection" will also enable the flow of air through the cavities within said intersecting CM block walls (called a "T-wall-connection") such as illustrated in FIG. 24 and herein described.

Reference is now made particularly to FIGS. 25–29 which schematically show still another modified embodiments, of biaxial CM apparatus and method using modifications of above-described mold core assemblies 42 and 44 in FIGS. 13–17 and 42*b* and 43 in FIGS. 18–19 that are indicated generally at 42*c* and 44*e*. Components of the modified embodiments shown in FIGS. 25–29 which are the same as corresponding components of the embodiment shown in FIGS. 13–17 or FIGS. 18–19 (and FIGS. 6–12) are identified by like numerals and letters. Components of the modified embodiment of FIGS. 25–29 which are similar to but changed from components of the embodiments shown in FIGS. 13–17 or FIGS. 18–19 (and FIGS. 6–12) are identified by the same numerals and letters as used in FIGS. 13–17 or FIGS. 18–19 and 6–12 plus the letter "e".

The biaxial CM block casting apparatus shown in FIGS. 25–28 and the biaxial CM casting process described with reference thereto are used for making a biaxially cast CM "L-block" or "corner block" such as shown in FIG. 29 and described with reference thereto. It is noted that the CM "L-block" shown in FIG. 29 may also be called a "triaxially cast" CM block, and that the CM casting apparatus and method disclosed in and with reference to FIGS. 25–28 may also be called a "triaxial CM casting apparatus" and a "triaxial CM casting method".

Mold core assembly 42c in the embodiment of FIGS. 25–29 is constructed and operated in the same way as mold core assembly 42c shown at the left of FIG. 20, with mold core assembly 42c. See above description of mold core assembly 42c with reference to mold core assemblies 42 and 44 in FIGS. 13–17 and modified mold core assembly 44b of FIGS. 18–19 (which is incorporated herein by reference and thus is not repeated here). As in the embodiment in FIGS. 20–23, when the axial plungers 66 and 64b are extended the end 67 of outer axial plunger 66 will engage the adjacent shorter mold side 54 of mold 52 and the end 65b of inner axial plunger 64b will engage the wall 53c of the mold core 49e of mold core assembly 44e. Thus extended plunger 64b will provide a cylindrical end section of plunger 64b which spans the space between wall 53a of mold core assembly 42c and has its end 65b engaging wall 53c of mold core assembly 44e as shown in FIGS. 25 and 27 in a manner like operation of plunger 64b in mold core assembly 42c as shown in FIG. 20 and described with reference thereto.

The embodiment of FIGS. 25–28 incorporates a mold core assembly 44e which is similar to the mold core assembly 44d of the embodiment of FIGS. 20–23 with respect to mounting and orientation of the plunger sub-assembly in mold core 49e; but core 49e of mold core assembly 42e differs from mold core 49d and the biaxial plunger sub-assembly of mold core assembly 44e also differs from mold core assembly 44d which has been fully described above in relation to mold core assembly 44 of FIGS. 13–17. The modified embodiment of mold core assembly 44e shown in FIGS. 25–28 further differs from the mold core assembly 44d in FIGS. 20–24 in like manner as single axial plunger of mold core assembly 42b of FIGS. 18–19 differs in construction and operation from mold core assembly 44 (or 42) of FIGS. 13–17 as above described with reference to the embodiment of FIGS. 18–19. In the embodiment of FIGS. 25–28 (analogous to the embodiment of FIGS. 18–19) mold core 49 has a planar wall 51 without any aperture such as shown at 59d in wall 51d of mold core assembly 44d at the right of FIGS. 20 and 21. Like above-described mold core assembly 42b of FIGS. 18–19, mold core assembly 44b is built analogously to mold core 44 (and mold core 42) described above in detail with reference to FIGS. 13–17; but, as described with reference to mold core assembly 42b in FIGS. 18–19, the manifold member in mold core assembly 44e corresponding to manifold 78 of mold core assembly 44 in FIGS. 13–17 is built with only one stationary piston such as shown at 87 in mold core assembly 44 (and 42) in FIG. 13 and with only one axial plunger 66d corresponding to plunger 66 in mold core assembly 44 shown in FIGS. 13–17.

The compressed air supply and air sensor arrangements for the mold core assembly 42c in the embodiment of FIGS. 25–28 is like that for the mold core assembly 42 described above with reference to FIGS. 13–17 and with reference to mold core assembly 42c of FIGS. 20–23. However, as in the above-described mold core assembly 42b in the embodiment of FIGS. 18–19, the manifold in mold core assembly 44e corresponding to manifold 78 in mold core assembly 44 (at the right of FIG. 13) is modified to provide only air conduits for operation of the single axial plunger 66d in mold core assembly 44e. However, the compressed air supply means and the air-plunger sensor means for the mold core assembly 42e are similar to those for the mold core assembly 42c at the left of FIGS. 18–19 as described above. That is compressed air supply means for mold core assembly 42e are connected to only one set of holes in the modified manifold 78 to actuate the single plunger 66d in relation to a single stationary piston to extend plunger 66d outwardly and retract it inwardly (similarly to operation of plunger 66 of mold core assembly 42b in the embodiment of FIGS. 18–19 described above). Further, as described with reference to mold core assembly 42b in FIGS. 18–19, only one nipple such as 184 in FIG. 13 is connected to mold core assembly 42e and connected to an air line such as 178 with that nipple disposed adjacent the inner end of axial plunger 66d of mold core assembly of 44e to sense and indicate when said plunger 66d of mold core assembly 44e is in fully retracted position in a manner like that described above with reference to mold core assembly 42b of FIGS. 18–19 compared to mold core assembly 42 (and 44) in the embodiment of FIGS. 13–17.

The embodiment of FIGS. 25–28 is shown in FIGS. 25 and 27 with the three axial plungers 66, 64b and 66d fully retracted similarly to retraction of plungers 64 and 66 in the phase of operation shown in FIG. 6 for the embodiment of FIGS. 13–17 (and also analogous to the phases of operation shown in FIGS. 11 and 12 for the embodiment of FIGS. 13–17). The embodiment of FIGS. 20–24 is shown in FIGS. 24 and 26 with the axial plungers 66 and 64b in extended position similarly to extension of plungers 64 and 66 shown in FIG. 7 for the embodiment of FIGS. 13–17 (and also analogous to extended position of said plungers for the phases of operation shown in FIGS. 8 and 9 for the embodiment of FIGS. 13–17).

It is believed that the construction of modified biaxial CM casting apparatus incorporating modified mold core assemblies 42c and 44d of FIGS. 25–28, and the mode of operation and functional results thereof according to the present invention will be clear to one skilled in the art from the disclosure herein particularly in light of the detailed disclosure of FIGS. 25–28 plus FIGS. 13–17 and FIGS. 18–19 with reference to FIGS. 6–12. It is also believed that the mode of operation of the biaxial CM casting process using the modified apparatus embodiment of FIGS. 25–28 according to the present invention and functional results thereof also will be fully apparent to one skilled in the art from the disclosure herein particularly in light of the detailed description of FIGS. 20–25 with reference to FIGS. 6–12 plus FIGS. 13–17 an FIGS. 18–19.

Reference is now made particularly to FIGS. 29 and 5A (with reference also to FIG. 1, and FIGS. 2–5). FIG. 29 shows an embodiment of biaxially cast CM "L-block" made by using the above-described biaxial CM casting apparatus shown in FIGS. 25–28 and using a biaxial CM casting method disclosed above with reference to said figures. The L-block made by this modification of biaxial CM casting apparatus and method of FIGS. 25–28 according to the present invention is generally indicated at 30e in FIG. 29 and comprises a pair of longitudinally extending face shells 31c and 31 which are interconnected by laterally extending end web 32b, central web 34a, and end web 32c thereby forming two cavities 35c and 35e which extend through CM L-block 30e from the top to the bottom thereof in the direction of the axis of casting as will be apparent from FIG. 29 with reference to the other figures mentioned (in the first two sentences of this paragraph). The end web 32b and the central web 34*a* are each provided with openings 40 which are made by varying the mold cavity during casting and timing such variation of said mold cavity in such a way as to vary the shape of the CM block 30*e* to provide web openings 40 extending in the direction of a second axis normal to the first axis of casting without a secondary manufacturing operation, as herein disclosed. It is noted that end web 32*c* is not provided with such an opening 40 (in contrast to biaxially cast CM block 30*b* shown in FIG. 5A and biaxially cast CM block 30*a* shown in FIGS. 2–5). The biaxially cast CM L-block 30*e* is also provided with one opening 40*d* in a portion of the face shell 31*c* in the region of cavity 35*e* of block 30*e*, and said opening 40 extends in the direction of a third axis normal to the axis of casting and also normal to said second axis of openings 40 in webs 32*b* and 34*a*. More particularly, said openings 40 in end web 32*b* and central web 34*a* are made by varying the mold cavity during casting and timing such variation by selectively using plungers 66 and 64*b* of the mold core assembly 42*c* in extended and retracted positions as shown in FIGS. 25–28 and above explained. Said opening 40*d* in the face shell 31*c* is made by varying the mold cavity during casting and timing such variation of the mold cavity in such a way as to result in variation of the shape of the CM block 30*e* to provide openings 40*d* extending normal to the axis of casting and also normal to said second axis of web openings 40 without any secondary r tertiary manufacturing operation as explained herein. More particularly, said opening 40*d* in face shell 31*c* is made by selectively timed extension and retraction of the single axial plunger 66*d* of mold core assembly 44*e* of the apparatus disclosed in FIGS. 25–28 in the operation of said apparatus to perform the biaxial CM casting method described above with reference to FIGS. 25–28.

Referring again now particularly to FIG. 29, the resultant L-block 30*e* may be joined at its end which has opening 40*d* in face shell 31*c* to a biaxially cast CM block 30*b* of configuration such as shown in FIG. 5A at the end of a CM block wall section made up of CM blocks like 30*b* (or 30*a*) so that the opening 40 in the end web 32*b* of the adjoining end block 30*b* of such a CM block wall section will be in communication with opening 40*d* in face shell 31*c* of L-block 30*e* and thus also with cavity 35*e* of such block 30*e*. Hence, piping and/or electrical conduits or the like can be extended through openings 40 in any of such CM blocks 30*b* into and through face shell opening 40*d*, cavity 35*e* and web openings 40 of L-block 30*e* and then extended at the corner of the two adjoining CM block walls into the perpendicular intersecting wall made up of biaxially cast CM blocks 30*b* having openings 40 in the end and central webs thereof, as will be apparent to one skilled in the art in light of the showing of CM blocks 30*b* in conjunction with CM L-block 30*e* in FIG. 29 and explanation thereof herein. It also will be apparent that the biaxially cast CM T-block 30*e* used in conjunction with the biaxially cast CM blocks 30*b* as shown in FIG. 29 and herein explained to provide a "corner connection" will also enable the flow of air through the cavities within said intersecting CM block walls (called a "CM block walls corner connection") such as illustrated in FIG. 29 and herein described.

Reference is made now to FIGS. 13–15 for discussion of another modification which is not disclosed as such in the drawings but which will be described with reference to changes made in components shown in said figures. In the embodiment of FIGS. 13–17, the core bar and mounting assembly generally indicated at 46 and particularly shown in FIGS. 13–15 includes a conventional type commercially available core bar assembly comprising an elongated core bar 72 with a pair of transversely extending mounting brackets 74 at opposite ends thereof and air couplings 124 and 126 mounted on core bar 72 by welding or any other suitable manner. There are also mounted on core bar 72 air conduit means for connection to a compressed air source and mold core assemblies 42 and 44 for operation thereof to, extend and retract the axial plungers 64 and 66. Such air conduit means comprises tubing 144 and 148 plus tubing 128 and related air conduit means connected to and via air blocks 124 and 126 to extend the plungers 64 and 66; and the air conduits for retracting axial plungers 64 and 66 constitutes air tubing 146 and 150 and 132 connected to and via air couplings 124 and 126. Also, the low pressure air conduit for the "air sensor" means to indicate whether or not axial plungers 64 and 66 are fully retracted comprises flexible tubing 178 and air tubing 178*a* connected to and via air couplings 124 and 126. In lieu of conventional core bar 72, a modified core bar (not shown) may be made incorporating (a) the equivalent of air couplings 124 and 126 and air conduit means 144, 124, 128, 148, 126, 128 for extending plungers 64 and 66, plus (b) the equivalent of air conduit means 146, 124, 132, 150, 126, 132, plus also (c) the equivalent of low air pressure conduit 178*a*, 124, 178, 178*b*, 126 and 178. To accomplish this modified core bar assembly embodiment, at least some of said equivalent air conduit means would be formed within a portion of the modified core bar (similar to 72) which will probably be made in two or more parts welded or similarly secured together. This will make such modification of core bar assembly 46 shown in FIG. 13–15 more compact and thereby provide advantages for use of a biaxial CM mold core system like that generally indicated at 41 and thus modified as herein discussed. It will be apparent to those skilled in the art in light of the disclosure herein with reference to the embodiment of FIGS. 13–17 that such modification of core bar 72 to incorporate in the core bar air couplings 124 and 126 and related air conduits extending to, between and from air couplings 124 and 126 may be done in various ways according to such modification of the embodiment of FIGS. 13–15 as herein discussed.

Reference is now made particularly to FIGS. 30–31 which disclose a "biaxial maintenance module" generally indicated at 182 which is used for cleaning the axial plungers 64 and 66 of mold core assemblies 42 and 44 of the biaxial CM mold core system 41 shown in FIGS. 13–17 at the end of a particular run or working day or the like. The maintenance module 182 comprises a base 184 and two side walls 185 and 186 connected at their lower edges to base 184, plus two like end frames 188 connected along their bottom sides to base 184 and along their vertically extending edges to sides 185 and 186. The maintenance module 182 also includes a center frame 189 connected at the bottom thereof to base 184 and at the sides thereof to side walls 185 and 186. The two like end frames 188 and center frame 189 may be made in any suitable manner for purposes of mounting below-described cleaning sponges (or equivalent) for cleaning the axial plungers of mold cores 42 and 44; and the particular construction of the biaxial maintenance module 182 shown in FIGS. 20–22 and below described in detail is exemplary. Each of like end frames 188 and also middle frame 189 is made up of two vertically extending angle-shaped members 190 interconnected by a pair of horizontally extending members 191 to form three substantially square outer frames comprising part of end frames 188 and center frame 189. Four triangular gussets 192 are secured to members 190 and 191 which form the outer square framework of each of end frames 188 and middle frame 189 as will be apparent from the drawings, particularly FIGS. 30 and 31. Referring to end frames 188, a cylindrical member 194 of relatively short length is mounted within and secured to gussets 192 of each of end frames 188 in the center thereof in any suitable manner. Similarly, a cylindrical member 195 of relatively short length is mounted within and secured to gussets 192 in the central portion of center frame 189 in any suitable manner. The bottom 184, sides 185 and 186, end frames 188 and center frame 189 may be formed of any suitable material, and such components preferably are made of a strong transparent plastic material selected from one of several commercially available plastic materials which are suitable for the construction and usage of biaxial maintenance module 182. Typically, bottom 184 and sides 185 and 186 would be about ½ inch thick and members 191 and 192 could be ¼41 X 1" angles. An annular ring 196 of sponge rubber (or suitable equivalent material) is mounted in each of cylinders 194 in end frames 188, as shown particularly in FIG. 32. A circular piece of sponge rubber (or suitable equivalent material) indicated at 198 is mounted over the outer face portions of cylindrical sponge rubber rings 196 and secured to cylinders 194 on each of end frames 188, as will be apparent particularly from FIGS. 32 and 31 of the drawings. Two rings of sponge rubber **196*a* with a circular piece of sponge rubber 198*a* disposed therebetween is mounted in the cylindrical member 195 in the central frame member 189 as shown particularly in FIGS. 32 and 31 of the drawings. In a typical commercial embodiment of the biaxial maintenance module 182, the sponge rings 196 would be about one inch thick and have an outside diameter of about 5 ½ inches sized to fit within the inside diameter of rings 194 in which said sponge rubber rings 196 are secured by any suitable means. Also, the rings 196 would have an inner diameter slightly smaller than the outer diameter of axial plungers 64 and 66 of the mold core assemblies 42 and 44 which are shown particularly in FIG. 13 (and likewise with respect to the plungers of modified mold core assemblies 42*b* and 44*b* of the modified embodiments of FIGS. 18–19). The sponge rings 196*a* would be approximately one-half inch thick (or slightly more) and would have an outer diameter and inner diameter similar to that of rings 196 as above discussed. The circular sponge members 198 disposed on the outer sides of sponge rubber rings 196 of end frames 188 and the circular sponge member 198*a* disposed between sponge rubber rings 196*a* in the middle frame 189 are made of sponge rubber (or equivalent suitable material) about ⅛ inch thick in a typical embodiment of biaxial maintenance module 182**.

At the end of a run or at the end of a day, or the like, the biaxial maintenance module 182 is used to clean the cylindrical exteriors of axial plungers 64 and 66 and their respective end portions 65 and 67 of biaxial CM mold core system 41 shown in FIGS. 13–17. Referring now to FIGS. 6–12, the pallet 60 shown in said Figures is mounted on a vertically moving platen (not shown) which is incorporated in CM casting machine 48 and moves up and down with a pallet 60 to carry out various phases of CM biaxial molding process shown in FIGS. 6–12 and above described. To use the biaxial maintenance module 182, the platen is lowered below the mold box 52 of machine 48. The biaxial maintenance module 182 is placed on the thus lowered platen so that when the platen is raised (e.g., as indicated in FIG. 6), the mold core assemblies 42 and 44 will respectively enter into the two top open portions of maintenance module 182 with one of said mold core assemblies disposed between center frame 189 and end frame 188 and the other such assembly disposed between center frame 189 and the other end frame 188. The biaxial maintenance module 182 is raised within the mold box 52 so that the central axis of each of biaxial plungers 64 and 66 of the mold core assemblies 42 and 44 are coincident with the central axes of axially aligned rings 196 and **196*a*. The machine 48 is manually operated to cause the plungers 66 of each of the two mold core assemblies 42 to enter the inside of sponge rubber rings 196 with the plunger ends 167 engaging circular end sponges 198 on the frame ends 188. Plungers 64 of each of said mold core assemblies are simultaneously caused to enter into the centers of middle sponge rubber rings 196*a* with the ends 65 of axial plungers 64 engaging opposite surfaces of the circular sponge 198*a* mounted on the central frame member 189. The sponges 196, 196*a*, 198, and 198*a* are soaked in water and/or in a silicon containing liquid so as to better clean the surfaces and ends of the axial plungers 64 and 66 by the above-described biaxial maintenance module. Use of the biaxial maintenance module and cleaning of the axial plungers 64 and 66 and ends 65 and 67 thereof as above described is carried out by manual operation of the CM casting machine 48** by the operator.

The invention may be embodied in other specific forms without departing from the spirit or essential characteristics thereof. The present embodiments are therefore to be considered in all respects as illustrative and not restrictive, the scope of the invention being indicated by the appended claims rather than by the foregoing description, and all changes which come within the meaning and range of equivalency of the claims are therefore intended to be embraced therein.

What is claimed and desired to be secured by Letters Patent is:

1. A biaxial casting method for making a concrete masonry or CM block including a pair of opposing spaced face shells with at least three spaced webs extending transversely to and interconnecting said face shells and forming at least two cavities which are boundaried by said webs and portions of said face shells and extend through said CM block in the direction of an axis of casting of such block, said method using an apparatus adapted to be disposed in the mold of a CM casting machine with said mold including a mold box comprising four substantially vertically disposed side walls disposed in substantially rectangular plan configuration with a first pair of said side walls being longer than the second pair of said side walls, and said apparatus comprising: at least two mold cores substantially vertically disposed in said mold, said mold cores having substantially vertically disposed side walls arranged in substantially rectangular plan configuration, with a wall of each of said mold cores spaced from a wall of an adjacent mold core and other walls of said mold cores being spaced from side walls of said mold box so as to form a mold cavity which has a plan configuration like the plan of said CM block to be made, with the vertical axis of said mold cores extending in the direction of said axis of casting of said CM block to be made; at least one of said mold cores containing means for laterally projecting from within the periphery of said mold core to outwardly of at least one side of said mold core in like longitudinal direction as said first longer mold side walls to provide a temporary mold core laterally extending into said mold cavity in a direction transverse to said axis of casting; compressor/stripper means vertically movable with respect to said mold box and mold cores, pallet means vertically and laterally movable with respect to the bottom of said mold box, and CM material feed means laterally movable to above said mold box and away therefrom; said biaxial casting method for making said CM block comprising:

(a) disposing a pallet with respect to said mold box to provide a mold bottom; extending said laterally projecting means from at least one of said mold cores into said mold cavity to provide said temporary mold core laterally extending into said mold cavity along an axis transverse to said axis of casting; feeding CM mix into said mold cavity from said feeder means; and vertically lowering said compressor/stripper means and compressing said CM mix in said mold cavity to form a CM block having an opening extending through at least one of said webs of said CM block; and (b) retracting said laterally projecting means to within said periphery of said mold core containing same to remove said temporary mold core from said mold cavity; sensing with a sensing means whether said laterally projecting means has fully retracted from said mold cavity; moving said compressor/stripper means and said pallet downward to strip from said mold box said CM block disposed on said pallet when said sensing means has sensed that said laterally projecting means has fully retracted from said mold cavity; transferring said CM block and pallet laterally away from below said mold box; placing another pallet below said mold box and vertically raising said pallet to said mold box to provide a mold bottom; and vertically raising said compressor/stripper means from said mold box and disposing it out of the path of said laterally movable CM material feed means.

2. A biaxial casting method for making a concrete masonry or CM block including a pair of opposing spaced face shells with at least three spaced webs extending transversely to and interconnecting said face shells and forming at least two cavities which are boundaried by said webs and portions of said face shells and extend through said CM block in the direction of the axis of casting of said CM block, said method comprising:

(a) providing a CM casting machine with a mold including a mold box comprising four substantially vertically disposed side walls disposed in substantially rectangular plan configuration with a first pair of said side walls being longer than the second pair of said side walls;

(b) providing at least two mold cores substantially vertically disposed in said mold with said mold cores having substantially vertically disposed side walls arranged in substantially rectangular plan configuration, with a wall of each of said mold cores spaced from each other and other walls of said mold cores being spaced from side walls of said mold box so as to form a mold cavity which has a plan configuration similar to the plan configuration of said CM block to be made, with the vertical axis of said mold cores extending in the direction of said axis of casting of said CM block to be made, at least one of said mold cores containing means for laterally projecting from within the periphery of said mold core to outwardly of at least one side of said mold core in direction of a second axis which extends in like longitudinal direction as said first longer mold side walls and substantially normal to said axis of casting to provide a temporary mold core laterally extendable into said mold cavity in said direction of said second axis;

(c) providing a mold bottom for said mold box;

(d) extending said laterally projecting means outwardly from at least one of said mold cores into said mold cavity to provide said temporary mold core laterally extending into said mold cavity along said second axis;

(e) feeding CM mix into said mold cavity;

(f) compressing said CM mix in said mold cavity to form said CM block having an opening extending through at least one of said webs of said CM block;

(g) retracting said laterally projecting means to within said periphery of said mold core containing same to remove said temporary mold core from said mold cavity and sensing with a sensing means whether said laterally projecting means has fully retracted from said mold cavity;

(h) removing said mold bottom when said sensing means has sensed that said laterally projecting means has fully retracted from said mold cavity; and (i) removing said cast CM block from said mold box.

3. A biaxial casting method for making a concrete masonry block including a pair of opposing spaced face shells with at least three spaced webs extending transversely to interconnect said shells and form at least two cavities bounded by said webs and portions of said face shells, said cavities extending through said block in the direction of the axis of casting of said block, said method comprising the steps of:

(a) providing a CM casting machine with a mold including a mold box comprising four substantially vertically disposed side walls disposed in substantially rectangular plan configuration with a first pair of said side walls being longer than the second pair of said walls and providing at least two mold cores substantially vertically disposed in said mold;

(b) providing a mold bottom for said mold box;

(c) extending a laterally projecting means outwardly from at least one of said mold cores into the mold cavity to provide a temporary mold core laterally extending into said mold cavity along an axis generally perpendicular to said casting axis;

(d) feeding concrete mix into said mold cavity;

(e) compressing said mix in said mold cavity to form said block having an opening extending through at least one of said webs of said block;

(f) retracting said laterally projecting means from said concrete mix in said mold cavity to within the periphery of said mold core containing same to remove said temporary mold core from said mold cavity and sensing with a sensing means whether said laterally projecting means has fully retracted from said mold cavity;

(g) removing said mold bottom when said sensing means has sensed that said laterally projecting means has fully retracted from said mold cavity; and (h) removing said cast block from said mold box.

4. A biaxial casting method for making a concrete masonry block including at least one face shell with apparatus adapted to be disposed in a mold of a CM casting machine with said mold including a mold box comprising side wall means, said casting apparatus comprising at least one mold core means forming a mold cavity with said side wall means, said mold core means including means for laterally projecting outwardly from said mold core means into said mold cavity, comprising the steps of:

(a) providing a mold bottom for said casting apparatus;

(b) extending said laterally projecting means from said mold core means into said mold cavity to provide a temporary mold core extending into said mold cavity along a first axis;

(c) feeding concrete mix into said mold cavity along a second axis angularly offset from said first axis;

(d) compressing said mix into said mold cavity to form said concrete masonry block;

(e) retracting said laterally projecting means to within the periphery of said mold core means to remove said laterally projecting means from said mold cavity;

(f) sensing with a sensing means whether said laterally projecting means has completely retracted from said mold cavity;

(g) removing said mold bottom only when said sensing means has sensed that said laterally projecting means has completely retracted in accordance with step (f); and (h) removing said cast concrete block from said mold box.

5. The biaxial casting method of 4, wherein said mold includes a pair of substantially identical said mold core means with said laterally projecting means being respectively extendable and retractable along two different angularly offset first axes, and comprising the further step of extending said respective laterally projecting means along their respective first axis to provide a triaxially cast block.

6. The biaxial casting method of claim 4, wherein said mold core means includes at least a pair of said mold core means each having said laterally projecting means to form a concrete masonry block including a pair of opposing spaced face shells with at least three spaced webs extending transversely to interconnect said shells and form at least two cavities bounded by said webs and portions of said face shells.

7. The biaxial casting method of claim 4, comprising the further step of supplying air under pressure to a nipple means positioned within said mold core means to be blocked off by the outer periphery of said laterally projecting means in its fully retracted mode, and wherein said sensing step of subparagraph (f) includes the further step of detecting the occurrence of a predetermined minimum back pressure applied to said nipple means by blockage thereof with said outer periphery of said laterally projecting means to determine full retraction thereof, or incomplete retraction thereof when said detected pressure is below said predetermined minimum back pressure.

8. The biaxial casting method of claim 7, wherein said back pressure is determined with a pressure gauge indicating to an operator when said back pressure is greater than or equal to said predetermined minimum back pressure to enable manual intervention by said operator to prevent removal of said mold bottom when said indicated pressure is less than the predetermined minimum back pressure.

9. The biaxial casting method of claim 4, wherein said laterally projecting means is pneumatically extended and retracted.

10. The biaxial casting method of claim 9, wherein said laterally projecting means is extended into said mold cavity through an opening in a side wall of said mold core means.

11. The biaxial casting method of claim 10, comprising the further step of wiping an outer periphery of said laterally projecting means as it retracts into said mold core means utilizing sweeper gaskets disposed between said outer periphery of said laterally projecting means and within said mold core means.

12. The biaxial casting method of claim 10, wherein air is supplied into a hollow portion of said laterally projecting means against one side of a stationary piston head within said laterally projecting means to extend said laterally projecting means, and wherein air is sequentially supplied to within said laterally projecting means against an opposite side of said piston to retract said laterally projecting means.

13. The biaxial casting method of claim 12, comprising the further step of venting air from within said mold core means through said laterally projecting means to break a negative pressure and vacuum around said outer periphery of said laterally projecting means within said mold cavity filled with CM material as said laterally projecting means starts to retract from its extended mode.

14. The biaxial casting method of claim 13, comprising the further step of relieving air pressure between said laterally projecting means and said mold core means as said laterally projecting means starts to retract from said extended mode.

15. The biaxial casting method of claim 14, comprising the further step of supplying air under pressure to a nipple means positioned within said mold core means to be blocked off by said outer periphery of said laterally projecting means in its fully retracted mode, and wherein said sensing step of subparagraph (f) includes the further step of detecting the occurrence of a predetermined minimum back pressure applied to said nipple means by blockage thereof with said outer periphery of said laterally projecting means to determine full retraction thereof, or incomplete retraction thereof when said detected pressure is below the predetermined minimum back pressure.

* * * * *